US005876907A

United States Patent [19]

Arai

[11] Patent Number: 5,876,907

[45] Date of Patent: Mar. 2, 1999

[54] IMAGE FORMATION METHOD

[75] Inventor: Tsutomu Arai, Kanagawa, Japan

[73] Assignee: Fuji Photo Film Co., Ltd., Kanagawa, Japan

[21] Appl. No.: 959,735

[22] Filed: Oct. 28, 1997

Related U.S. Application Data

[63] Continuation of Ser. No. 613,438, Mar. 4, 1996, abandoned, which is a continuation of Ser. No. 320,390, Oct. 11, 1994, abandoned.

[30] Foreign Application Priority Data

Oct. 8, 1993 [JP] Japan ..... 5-253349

[51] Int. Cl.[6] ..... G03C 5/29

[52] U.S. Cl. ..... 430/440; 430/264; 430/446; 430/603

[58] Field of Search ..... 430/264, 440, 430/446, 542, 550, 598, 564, 603

[56] References Cited

U.S. PATENT DOCUMENTS

| | | | |
|---|---|---|---|
| 4,478,928 | 10/1984 | Hess et al. | 430/603 |
| 5,098,819 | 3/1992 | Knapp | 430/436 |
| 5,236,816 | 8/1993 | Purol et al. | 430/440 |
| 5,340,695 | 8/1994 | Yamaguchi | 430/264 |
| 5,340,704 | 8/1994 | Ezoe et al. | 430/264 |
| 5,384,232 | 1/1995 | Bishop et al. | 430/440 |

*Primary Examiner*—Hoa Van Le
*Attorney, Agent, or Firm*—Sughrue, Mion, Zinn, Macpeak & Seas, PLLC

[57] ABSTRACT

An image formation method, which comprises the steps of imagewise exposing a silver halide photographic material comprising a support having thereon at least one layer of a silver halide emulsion chemically sensitized with at least one selenium or tellurium compound, and then subjecting the material to development-processing with a developer containing substantially no dihydroxybenzene developing agent but containing a developing agent represented by the following formula (I):

(I)

wherein $R_1$ and $R_2$ are the same or different and each represents a hydroxyl group, an amino group, an acylamino group, an alkylsulfonylamino group, an arylsulfonylamino group, an alkoxycarbonylamino group, a mercapto group or an alkylthio group; P and Q are the same or different and each represents a hydroxyl group, a carboxyl group, an alkoxy group, a hydroxyalkyl group, a carboxyalkyl group, a sulfo group, a sulfoalkyl group, an amino group, an aminoalkyl group, an alkyl group, an aryl group or a mercapto group, or P and Q may represent an atomic group capable of forming a 5- to 8-membered ring by combined with each other and further by associating with two vinyl carbon atoms to which $R_1$ and $R_2$ are attached respectively and one carbon atom to which Y is attached; and Y represents ═O or ═N—$R_3$, wherein $R_3$ represents a hydrogen atom, a hydroxyl group, an alkyl group, an acyl group, a hydroxyalkyl group, a sulfoalkyl group or a carboxyalkyl group.

12 Claims, No Drawings

IMAGE FORMATION METHOD

This is a Continuation of application Ser. No. 08/613,438 filed Mar. 4, 1996, now abandoned, which is a Continuation of application Ser. No. 08/320,390 filed Oct. 11, 1994, now abandoned.

FIELD OF THE INVENTION

The present invention relates to an image formation method by using silver halide photographic materials and, more particularly, to a method capable of ensuring a high photographic speed, a low fog density and rapid processing suitability in the image formation under short-duration exposure with high illumination intensity.

BACKGROUND OF THE INVENTION

An image formation method of utilizing the so-called scanner system as an exposure system for silver halide photographic materials is known. Therein, a photographic material undergoes the exposure based on image signals obtained by scanning an original, and therethrough forms therein a negative or positive image corresponding to the original image.

Various recording apparatuses in which the image formation methods of utilizing the scanner system are embodied are used. Therein, the so-called dot generator system prevails at present. Such a scanner-utilized recording apparatus uses as the light source for recording a glow lamp, a xenon lamp, a mercury lamp, a tungsten lamp, a light emitting diode and so on.

All the light sources cited above, however, are inferior in practicality because they have weak power and short life. In order to remove these drawbacks of the above-cited light sources, coherent laser beams, such as beams emitted from He-Ne, argon, and semiconductor laser devices, are used as the light source of a scanner system.

Various characteristics are required for photosensitive materials to which a scanner system using coherent laser beams is applicable. Since the exposure time of such a scanner system is particularly short, that is, in the range of $10^{-3}$ to $10^{-8}$ second, it becomes essential for the photosensitive materials to ensure high photographic speed and high contrast even under such a short exposure. In addition, highly sensitive photosensitive materials are of greater advantage when the output is reduced for lengthening the life of a laser tube. For obtaining satisfactory halftone dots, on the other hand, it becomes necessary to properly adjust the shape of a laser beam with a slit or the like. The shape adjustment causes a reduction of the laser output, and in order to cope therewith a photosensitive material having high sensitivity is required.

Moreover, recent graphic arts industry has been strongly desirous of an improvement in working efficiency, or speeding-up of working. Accordingly, the speeding-up of scanning and for reduction in processing time of a photosensitive material is comprehensively needed.

In order to meet the needs of graphic arts, it is desirable that the exposure device (scanner, plotter) be designed such that the scanning may be speeded up and high image quality may be achieved by increasing the number of scanning lines and by narrowing down the beam emitted therefrom. As for the silver halide photographic materials, on the other hand, it is desirable that they have high sensitivity and processing stability and can be developed rapidly.

Besides the photosensitive materials for scanner system, photosensitive materials for photograph-taking use are also required to form therein satisfactory halftone dot images and line original images. Therefore, it is desirable for these materials also to have high sensitivity, excellent processing stability and rapid development suitability.

For desirable reproduction of continuous tone images with halftone dots or that of line original images in the field of graphic arts, there is the need of an image-forming system which can provide photographic properties including ultra-high contrast (especially a gamma value ($\gamma$) of at least 10).

As a method of achieving high contrast which is one of photographic characteristics, a lithographic development system making use of the so-called "infectious development effect" has been employed from old times. However, such a system has a defect that the developers usable therein are difficult to handle because of their instability. Therefore, development of another image formation system capable of providing the photographic characteristic of being ultra-high contrast through development with a sufficiently stable processing solution has been needed. Methods of embodying such a system are disclosed in, for example, U.S. Pat. Nos. 4,166,742, 4,168,977, 4,221,857, 4,224,401, 4,243,739, 4,269,922, 4,272,606, 4,311,781, 4,332,878, 4,618,574, 4,634,661, 4,681,836, 5,650,746. Therein, a silver halide photographic material of the kind which forms a latent images predominantly at the surface of the grains, and to which a hydrazine derivative is added, is developed with a stable MQ or PQ developer adjusted to pH 11.0–12.3, and thereby is produced a very high contrasty negative image having a gamma value greater than 10. According to those methods, the photographic characteristic of being ultra-high contrast and high sensitivity can be achieved, and the stability of the developer to aerial oxidation can be made higher by far than those of conventional lithographic developers since a sulfite can be added thereto in a high concentration.

However, conventional development systems use dihydroxybenzenes as developing agent, and therefore have some disadvantages from viewpoints of ecology and toxicology. For instance, hydroquinone is an undesirable agent because of its allergenic effect, and 1-phenyl-3-pyrazolidones are hard to undergo biological decomposition. In addition, sulfites added in a high concentration cause high COD (chemical oxygen demand).

On the other hand, enediols such as ascorbic acid are known to function as a developing agent, and deserve notice as the developing agent free from ecological and toxicological problems. For instance, U.S. Pat. Nos. 2,668,549 and 3,826,654 disclose that those compounds enable the image formation under a high alkaline condition such that the pH is higher than at least 12. In the image formation method of this type, however, the developability is rather low and the development proceeds slowly as compared with the method of using a dihydroxybenzene developing agent. That is, the image formation method of using enediols as developing agent has the problem of lack of rapid processing suitability. The term rapid processing as used herein refers to the processing in which it takes 15 to 60 seconds for the top end of a photosensitive material to travel from the insertion slit of an automatic developing machine to the exit of the drying part of the machine via the developing tank, the fixing tank, the washing tank and the drying part in succession.

Although raising the silver chloride contents in silver halide emulsions used in a photosensitive material is already known to be effective for speeding the progress of development, that is to say, for conferring rapid processing suitability on the photosensitive material, it causes the lowering of sensitivity and the aggravation of unevenness due to physical development. Further, it tends to cause a rise in fog density.

SUMMARY OF THE INVENTION

Therefore, an object of the present invention is to provide an image formation method by using a silver halide photographic material wherein high photographic speed is ensured to the photographic material and reduced fog and no unevenness caused by physical development are ensured to the image formed.

Another object of the present invention is to provide a development-processing method wherein a silver halide photographic material for high illuminance and short duration exposure can provide satisfactory image quality with a high photographic speed even when it undergoes rapid processing.

A further object of the present invention is to provide a new image formation method which uses a developer harmless to an ecosystem and work environment and ensures high photographic speed and sufficiently high image quality.

Still another object of the present invention is to provide a new image formation method wherein high contrasty images can be obtained using a developer harmless to an ecosystem and work environment.

The present inventor has found that chemical sensitization with at least one of a selenium compound and a tellurium compound can resolve the problems and can confer high photographic speed and rapid processing suitability on the photosensitive material. When a developer containing a dihydroxybenzene compound as developing agent was used, however, it has turned out that the chemical sensitization described above caused an increase in fog and a decrease in gradation to impair the image quality.

These and other objects have been achieved by an image formation method, which comprises the steps of imagewise exposing a silver halide photographic material comprising a support having thereon at least one layer of a silver halide emulsion chemically sensitized with at least one selenium or tellurium compound, and then subjecting the material to development-processing with a developer containing substantially no dihydroxybenzene developing agent but containing a developing agent represented by the following formula (I):

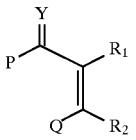

(I)

wherein $R_1$ and $R_2$ are the same or different and each represents a hydroxyl group, an amino group, an acylamino group, an alkylsulfonylamino group, an arylsulfonylamino group, an alkoxycarbonylamino group, a mercapto group or an alkylthio group; P and Q are the same or different and each represents a hydroxyl group, a carboxyl group, an alkoxy group, a hydroxyalkyl group, a carboxyalkyl group, a sulfo group, a sulfoalkyl group, an amino group, an aminoalkyl group, an alkyl group, an aryl group or a mercapto group, or P and Q may represent an atomic group capable of forming a 5- to 8-membered ring by combined with each other and further by associating with two vinyl carbon atoms to which $R_1$ and $R_2$ are attached respectively and one carbon atom to which Y is attached; and Y represents =O or =N—$R_3$, wherein $R_3$ represents a hydrogen atom, a hydroxyl group, an alkyl group, an acyl group, a hydroxyalkyl group, a sulfoalkyl group or a carboxyalkyl group.

DETAILED DESCRIPTION OF THE INVENTION

Specific constitutions of the present invention are described below in detail.

The silver halide emulsion of the present invention is chemically sensitized. In particular, it is chemically sensitized with at least one of a selenium compound and a tellurium compound.

Selenium sensitizers which can be used in the present invention include those disclosed in known patents. In general, selenium sensitization can be effected by adding an unstable selenium compound and/or a stable selenium compound to the silver halide emulsion and agitating the resulting emulsion at a high temperature of 40° C. or more for a definite time. Suitable examples of the unstable selenium compounds include those disclosed in JP-B-44-15748 (the term "JP-B" as used herein means an "examined Japanese patent publication), JP-B-43-13489, JP-A-4-25832 (the term "JP-A" as used herein means a "unexamined published Japanese patent application"), JP-A-4-109240, Japanese Patent Application No. 3-82929 and JP-A-4-271341. Specific examples of a unstable selenium sensitizer include isoselenocyanates (e.g., aliphatic isoselenocyanates such as allylisoselenocyanate), selenoureas, selenoketones, selenoamides, selenocarboxylic acids (e.g., 2-selenopropionic acid, 2-selenobutyric acid), selenoesters, diacylselenides (e.g., bis(3-chloro-2,6-dimethoxybenzoyl) selenide), selenophosphates, phosphinoselenides, and colloidal metallic selenium.

Although suitable examples of unstable selenium compounds are cited above, the present invention should not be construed as being limited to those compounds. Talking of unstable selenium compounds as a sensitizer for photographic emulsions, it is generally understood by those skilled in the art that the structure of a selenium compound is not particularly important so far as the selenium atom therein is unstable, that is to say, the organic moiety of a selenium sensitizer molecule has no function except that it holds a selenium atom and renders the sensitizer molecule unstable in a photographic emulsion. In the present invention, any of unstable selenium compounds falling under such a wide conception can be used to advantage.

On the other hand, examples of the stable selenium compounds which can be used in the present invention include those disclosed in JP-B-46-4553, JP-B-52-34492 and JP-B-52-34491. Specific examples of such stable selenium compounds include selenious acid, potassium selenocyanide, selenazoles, quaternary salts of selenazoles, diaryl selenides, diaryl diselenides, dialkyl selenides, dialkyl diselenides, 2-selenazolidinedione, 2-selenoxazolidinethione and derivatives thereof.

Of these selenium compounds, those represented by the following formulae (III) and (IV) are preferred:

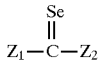

(III)

-continued

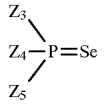

(IV)

In formula (III), $Z_1$ and $Z_2$ are the same or different, and each represents an alkyl group (e.g., methyl, ethyl, t-butyl, adamantyl, t-octyl), an alkenyl group (e.g., vinyl, propenyl), an aralkyl group (e.g., benzyl, phenetyl), an aryl group (e.g., phenyl, pentafluorophenyl, 4-chlorophenyl, 3-nitrophenyl, 4-octylsulfamoylphenyl, α-naphthyl), a heterocyclic group (e.g., pyridyl, thienyl, furyl, imidazolyl), $-NW_1(W_2)$, $-OW_3$ or $-SW_4$.

In formula (III), $W_1$, $W_2$, $W_3$ and $W_4$ may be the same or different, and each represents an alkyl group, an aralkyl group, an aryl group or a heterocyclic group. Herein, specific examples of the alkyl, aralkyl, aryl and heterocyclic groups represented by $W_1$ to $W_4$ include the groups cited as examples of those for $Z_1$ respectively. As for $W_1$ and $W_2$, however, they each may further be a hydrogen atom or an acyl group (e.g. acetyl, propanoyl, benzoyl, heptafluorobutanoyl, difluoroacetyl, 4-nitrobenzoyl, α-naphthoyl, 4-trifluoromethylbenzoyl).

In formula (III), $Z_1$ is preferably an alkyl group, an aryl group or $-NW_1(W_2)$ and $Z_2$ is preferably $-NW_5(W_6)$. Herein, $W_1$, $W_2$, $W_5$ and $W_6$ may be the same or different, and each represents a hydrogen atom, an alkyl group, an aryl group or an acyl group.

Of the compounds represented by, formula (III), N,N-dialkylselenoureas, N,N,N-trialkyl-N'-acylselenoureas, tetraalkylselenoureas, N,N-dialkyl-arylselenoamides and N-alkyl-N-aryl-arylselenoamides are more preferred.

In formula (IV), $Z_3$, $Z_4$ and $Z_5$ are the same or different, and each represents an aliphatic group, an aromatic group, a heterocyclic group, $-OW_7$, $-NW_8(W_9)$, $-SW_{10}$, $-SeW_{11}$, X or a hydrogen atom.

$W_7$, $W_{10}$ and $W_{11}$ each represents an aliphatic group, an aromatic group, a heterocyclic group, a hydrogen atom or a cation; $W_8$ and $W_9$ each represents an aliphatic group, an aromatic group, a heterocyclic group or a hydrogen atom; and X represents a halogen atom.

The aliphatic groups represented by any of $Z_3$, $Z_4$, $Z_5$, $W_7$, $W_8$, $W_9$, $W_{10}$ and $W_{11}$, in formula (IV) include straight-chain, branched or cyclic alkyl, alkenyl, alkinyl and aralkyl groups (e.g., methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentinyl, benzyl, phenetyl).

The aromatic groups represented by any of $Z_3$, $Z_4$, $Z_5$, $W_7$, $W_8$, $W_9$, $W_{10}$ and $W_{11}$ in formula (IV) include monocyclic and condensed-ring aryl groups (e.g., phenyl, pentafluorophenyl, 4-chlorophenyl, 3-sulfophenyl, α-naphthyl, 4-methylphenyl).

The heterocyclic groups represented by any of $Z_3$, $Z_4$, $Z_5$, $W_7$, $W_8$, $W_9$, $W_{10}$ and $W_{11}$, in formula (IV) include 3- to 10-membered saturated and unsaturated ones in which at least one nitrogen, oxygen or sulfur atom is contained as a ring member (e.g., pyridyl, thienyl, furyl, thiazolyl, imidazolyl, benzimidazolyl).

The cations represented by any of $W_7$, $W_{10}$ and $W_{11}$ in formula (IV) include alkali metals and ammonium ions, and the halogen atom represented by X therein includes fluorine, chlorine, bromine and iodine atoms.

In formula (IV), $Z_3$, $Z_4$ or $Z_5$ is preferably an aliphatic group, an aromatic group or $-OW_7$, wherein $W_7$ is preferably an aliphatic group or an aromatic group.

Of the compounds represented by formula (IV), a trialkylphosphine selenide, a triarylphosphine selenide, a trialkylselenophosphate or a triarylselenophosphate are more preferred.

Specific examples of the compounds represented by formulae (III) and (IV) are illustrated below. However, the invention should not be construed as being limited to these examples.

1.

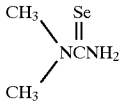

2.

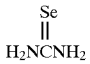

3.

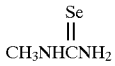

4.

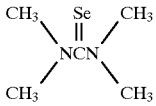

5.

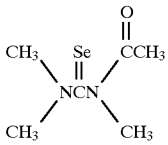

6.

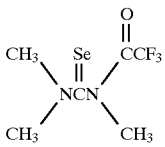

7.

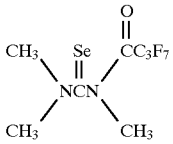

8.

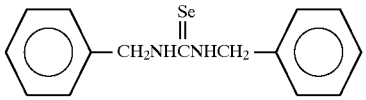

9.

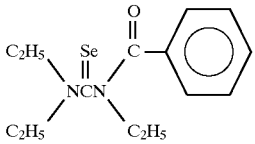

10.

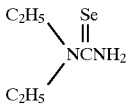

11.

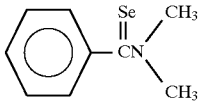

12.

-continued
13.
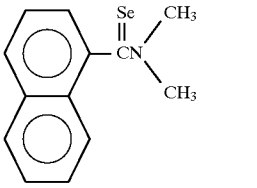
14.
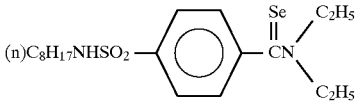
15.
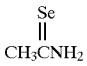
16.
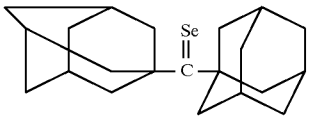
17.
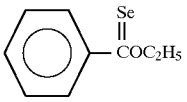
18.
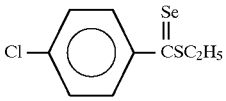
19.
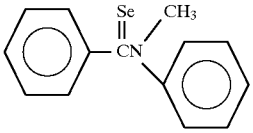
20.
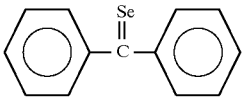
21.
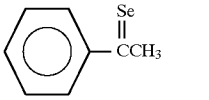
22.
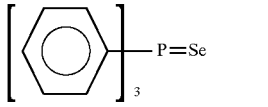
23.
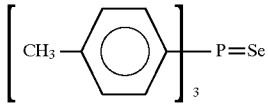
24.
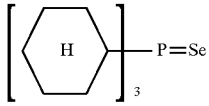
25.
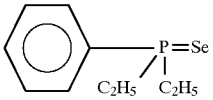
26.
-continued
27.
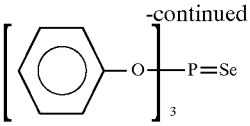
28.
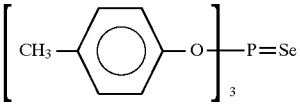
29.
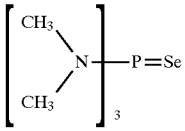
30.
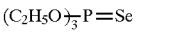
31.
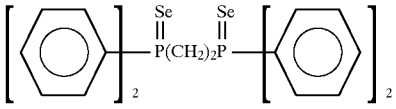
32.
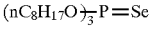
33.
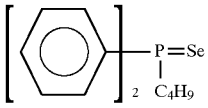
34.
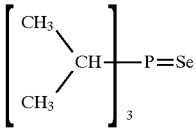
35.
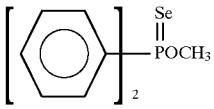
36.
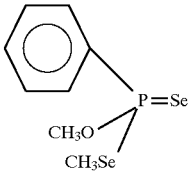
37.
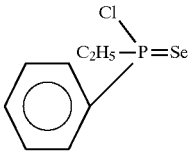
38.
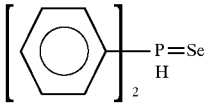
39.
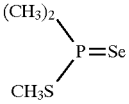
40.
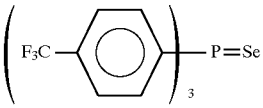

-continued

41.

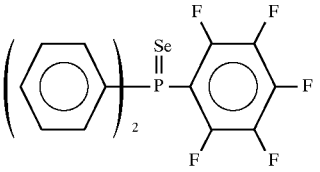

42.

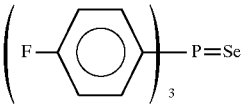

43.

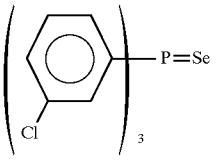

Tellurium sensitizers which can be used to advantage in the present invention include the compounds disclosed in U.S. Pat. Nos. 1,623,449, 3,320,069 and 3,772,031, British Patents 235,211, 1,121,496, 1,295,462 and 1,396,696, Canadian Patent 800,958, and JP-A-4-204640, JP-A-4-271341, JP-A-4-333043, JP-A-5-303157: and the compounds described, e.g., in *J. Chem. Soc. Chem. Commun.*, 635 (1980); ibid., 1102 (1979); ibid., 645 (1979); *J. Chem. Soc. Perkin Trans.*, 1, 2191 (1980); S. Patai (editor), *The Chemistry of Organic Selenium and Tellurium Compounds*, vol. 1 (1986) and vol. 2 (1987).

Specific examples of the tellurium sensitizers include colloidal tellurium, telluroureas (e.g., allyltellurourea, N,N-dimethyltellurourea, tetramethyltellurourea, N-carboxyethyl-N',N'-dimethyltellurourea, N,N'-dimethylethylenetellurourea, N,N'-diphenylethylenetellurourea), isotellurocyanates (e.g., allylisotellurocyanate), telluroketones (e.g., telluroacetophenone), telluroamides (e.g., telluroacetamide, N,N-dimethyltellurobenzamide), tellurohydrazides (e.g., N,N',N'-trimethyltellurobenzohydrazide), telluroesters (e.g., t-butyl-t-hexyltelluroester), phosphine tellurides (e.g., tributylphosphine telluride, tricyclohexylphosphine telluride, triisopropylphosphine telluride, butyldiisopropylphsophine telluride, dibutylphenylphosphine telluride), diacyl (di) tellurides (e.g., bis(diphenylcarbamoyl) ditelluride, bis(N-phenyl-N-methylcarbamoyl) ditelluride, bis(N-phenyl-N-methylcarbamoyl) telluride, diethylcarbamoyl telluride, bis (ethoxycarbaonyl) telluride), (di)tellurides and other tellurium compounds (e.g., the negatively charged telluride ion-containing gelatin, potassium telluride, potassium tellurocyanate, sodium telluropentathionate, allyl tellurocyanate disclosed in British Patent 1,295,462).

Of these tellurium compounds, those represented by the following formulae (V), (VI) and (VII) are preferable:

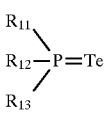

(V)

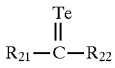

(VI)

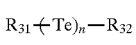

(VII)

In formula (V), $R_{11}$, $R_{12}$ and $R_{13}$ are the same or different and each represents an aliphatic group, an aromatic group, a heterocyclic group, $-OR_{14}$, $-NR_{15}(R_{16})$, $-SR_{17}$, $-OSiR_{18}(R_{19})(R_{20})$, X or a hydrogen atom; $R_{14}$ and $R_{17}$ each represents an aliphatic group, an aromatic group, a heterocyclic group, a hydrogen atom or a cation; $R_{15}$ and $R_{16}$ each represents an aliphatic group, an aromatic group, a heterocyclic group or a hydrogen atom; $R_{18}$, $R_{19}$ and $R_{20}$ each represents an aliphatic group; and X represents a halogen atom.

Further, formula (V) is described in detail.

The aliphatic groups represented by any of $R_{11}$, $R_{12}$, $R_{13}$, $R_{14}$, $R_{15}$, $R_{16}$, $R_{17}$, $R_{18}$, $R_{19}$ and $R_{20}$ in formula (V) are preferably one which has from 1 to 30 carbon atoms, more preferably a straight-chain, branched or cyclic alkyl, alkenyl, alkinyl and aralkyl groups having from 1 to 20 carbon atoms, with specific examples including methyl, ethyl, n-propyl, isopropyl, t-butyl, n-butyl, n-octyl, n-decyl, n-hexadecyl, cyclopentyl, cyclohexyl, allyl, 2-butenyl, 3-pentenyl, propargyl, 3-pentinyl, benzyl and phenetyl groups.

The aromatic groups represented by any of $R_{11}$, $R_{12}$, $R_{13}$, $R_{14}$, $R_{15}$, $R_{16}$ and $R_{17}$ in formula (V) are preferably one which has from 6 to 30 carbon atoms, more preferably a monocyclic or condensed-ring aryl group having from 6 to 20 carbon atoms, with specific examples including phenyl and naphthyl groups.

The heterocyclic groups represented by any of $R_{11}$, $R_{12}$, $R_{13}$, $R_{14}$, $R_{15}$, $R_{16}$ and $R_{17}$ in formula (V) include 3- to 10-membered saturated or unsaturated hetero-ring groups in which at least one nitrogen, oxygen or sulfur atom is contained as a ring member. Such hetero rings may be single rings, or condensed ones in which a hetero ring and an aromatic ring or another hetero ring are condensed together. Of such heterocyclic groups, 5- and 6-membered aromatic hetero-ring groups are preferred. Specific examples of those hetero-ring groups include pyridyl, furyl, thienyl, thiazolyl, imidazolyl and benzimidazolyl groups.

The cations represented by any of $R_{14}$ and $R_{17}$ in formula (V) include alkali metal and ammonium ions.

Examples of the halogen atom represented by X in formula (V) includes fluorine, chlorine, bromine and iodine atoms.

The aliphatic, aromatic and heterocyclic groups described above may be substituted by one or more substituents. Suitable examples of the substituents include an alkyl group, an aralkyl group, an alkenyl group, an alkinyl group, an aryl group, an alkoxy group, an aryloxy group, an amino group, an acylamino group, a ureido group, a urethane group, a sulfonylamino group, a sulfamoyl group, a carbamoyl group, a sulfonyl group, a sulfinyl group, an alkoxycarbonyl group, an aryloxycarbonyl group, an acyl group, an acyloxy group, an amide phosphoric acid group, diacylamino group, an imido group, an alkylthio group, an arylthio group, a halogen atom, a cyano group, a sulfo group, a carboxy group, a hydroxyl group, a phosphono group, a nitro group and a heterocyclic group. These groups may be further substituted.

When two or more groups can be present as substituents in the foregoing aliphatic, aromatic or heterocyclic group, they may be the same or different ones.

Further, $R_{11}$, $R_{12}$ and $R_{13}$ may combine with each other to form a ring together with a phosphorus atom, and $R_{15}$ and $R_{16}$ may combine with each other to form a nitrogen-containing heterocyclic ring.

In formula (V), $R_{11}$, $R_{12}$ and $R_{13}$ are preferably an aliphatic group or an aromatic group, more preferably an alkyl group or an aromatic group.

In formula (VI), $R_{21}$ represents an aliphatic group, an aromatic group, a heterocyclic group or $-NR_{23}(R_{24})$, and $R_{22}$ represents $-NR_{25}(R_{26})$, $-N(R_{27})N(R_{28})R_{29}$ or $-OR_{30}$. $R_{23}$, $R_{24}$, $R_{25}$, $R_{26}$, $R_{27}$, $R_{28}$, $R_{29}$ and $R_{30}$ each represents a hydrogen atom, an aliphatic group, an aromatic group, a heterocyclic group or an acyl group. Herein, a ring may be formed by combining $R_{21}$ with $R_{25}$, $R_{21}$ with $R_{27}$, $R_{21}$ with $R_{28}$, $R_{21}$ with $R_{30}$, $R_{23}$ with $R_{25}$, $R_{23}$ with $R_{27}$, $R_{23}$ with $R_{28}$, or $R_{23}$ with $R_{30}$.

Formula (VI) is further described in detail.

Aliphatic, aromatic and heterocyclic groups included in the groups represented by any of $R_{21}$, $R_{23}$, $R_{24}$, $R_{25}$, $R_{26}$, $R_{27}$, $R_{28}$, $R_{29}$ and $R_{30}$ have the same meaning as those in formula (II) respectively.

The acyl groups represented by $R_{23}$, $R_{24}$, $R_{25}$, $R_{26}$, $R_{27}$, $R_{28}$, $R_{29}$ and $R_{30}$ in formula (VI) is preferably one which has from 1 to 30 carbon atoms, more preferably a straight-chain or branched acyl group having from 1 to 20 carbon atoms. Specific examples of the acyl group include acetyl, benzoyl, formyl, pivaroyl and decanoyl groups.

When a combination of $R_{21}$ with $R_{25}$, $R_{21}$ with $R_{27}$, $R_{21}$ with $R_{28}$, $R_{21}$ with $R_{30}$, $R_{23}$ with $R_{25}$, $R_{23}$ with $R_{27}$, $R_{23}$ with $R_{28}$, or $R_{23}$ with $R_{30}$ forms a ring, it represents, e.g., an alkylene group, an arylene group, an aralkylene group or an alkenylene group.

Also, the foregoing aliphatic, aromatic and heterocyclic groups in formula (VI) may be substituted with the same substituents as recited in the description of formula (V).

In formula (VI), $R_{21}$ is preferably an aliphatic group, an aromatic group or $-NR_{23}(R_{24})$ and $R_{22}$ is preferably $-NR_{25}(R_{26})$. Herein, $R_{23}$, $R_{24}$, $R_{25}$ and $R_{26}$ are preferably an aliphatic or aromatic group.

More preferably, $R_{21}$ is an aromatic group or $-NR_{23}(R_{24})$, and $R_{22}$ is $-NR_{25}(R_{26})$. Herein, $R_{23}$, $R_{24}$, $R_{25}$ and $R_{26}$ are more preferably an alkyl or aromatic group. It is also more preferable in formula (VI) that the combination of $R_{21}$ with $R_{25}$ or that of $R_{23}$ with $R_{25}$ represent an alkylene, arylene, aralkylene or alkenylene group to form a ring.

In formula (VII), $R_{31}$ and $R_{32}$ are the same or different, and each represents an aliphatic group, an aromatic group, a heterocyclic group or —(C═Y')-$R_{33}$; and n represents 1 or 2. Herein, $R_{33}$ represents a hydrogen atom, an aliphatic group, an aromatic group, a heterocyclic group, $-NR_{34}(R_{35})$, $-OR_{36}$ or $-SR_{37}$, and Y' represents an oxygen atom, a sulfur atom or $-N(R_{38})-$; wherein $R_{34}$, $R_{35}$, $R_{36}$, $R_{37}$ and $R_{38}$ each represents a hydrogen atom, an aliphatic group, an aromatic group or a heterocyclic group.

Formula (VII) is described below in detail.

Aliphatic, aromatic and heterocyclic groups included in the groups represented by any of $R_{31}$, $R_{32}$, $R_{33}$, $R_{34}$, $R_{35}$, $R_{36}$, $R_{37}$ and $R_{38}$ have the same meaning as those in formula (V) respectively.

Also, the foregoing aliphatic, aromatic and heterocyclic groups in formula (VII) may be substituted with the same substituents as recited in the description of formula (V).

Therein, the combination of $R_{31}$ with $R_{32}$ and that of $R_{34}$ with $R_{35}$ may form a ring.

In formula (VII), $R_{31}$ and $R_{32}$ are preferably a heterocyclic group or —(C═Y')-$R_{33}$. Herein, $R_{33}$ represents $-NR_{34}(R_{35})$ or $-OR_{36}$, Y' represents an oxygen atom, and $R_{34}$ and $R_{35}$ each represents an aliphatic, aromatic or heterocyclic group.

Specific examples of the compounds represented by formulae (V), (VI) and (VII) respectively are illustrated below. However, the invention should not be construed as being limited to these examples.

1. $(nC_4H_9)_3P{=}Te$

2. $(tC_4H_9)_3P{=}Te$

3. 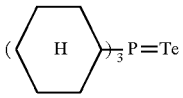

4. $((i)C_3H_7)_3P{=}Te$

5. 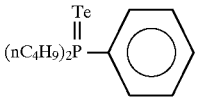

6. 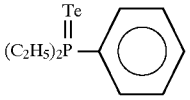

7. $((i)C_4H_9)_3P{=}Te$

8. $((i)C_4H_9)_2P(Te)C_4H_9(n)$

9. $(i)C_3H_7P(Te)(C_4H_9(n))_2$

10. $((i)C_3H_7)_2P(Te)(C_4H_9(n)$

11. $(i)C_3H_7P(Te)(C_4H_9(i))_2$

12. $((i)C_3H_7)_2P(Te)C_4H_9(i)$

13. $((i)C_3H_7)_2P(Te)C_8H_{17}(n)$

14. $C_2H_5P(Te)(OC_2H_5)_2$

15. $(nC_4H_9O)_3P{=}Te$

-continued
16.
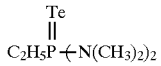
17.
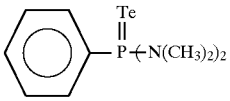
18.
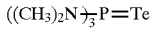
19.
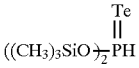
20.
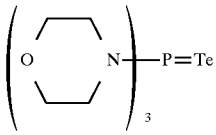
21.
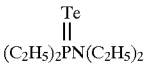
22.
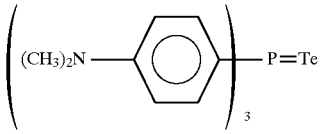
23.
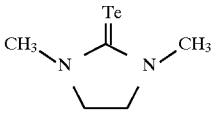
24.
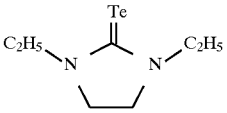
25.
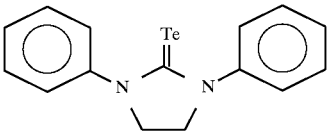
26.
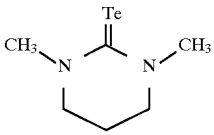
-continued
27.
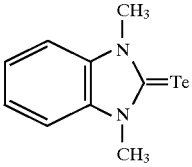
28.
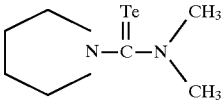
29.
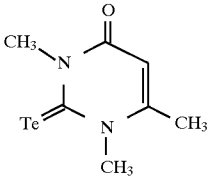
30.
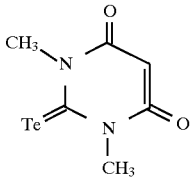
31.
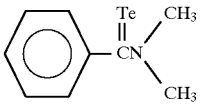
32.
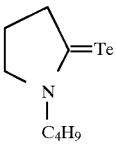
33.
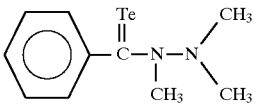
34.
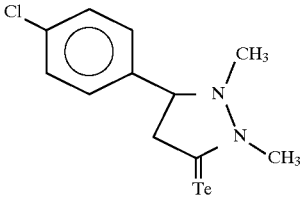

-continued
35.
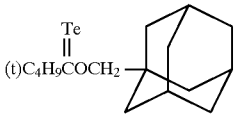
36.
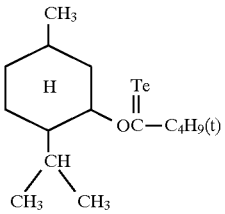
37.
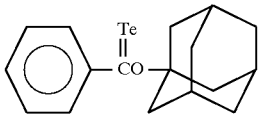
38.
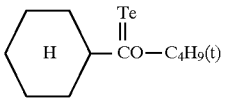
39.
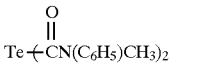
40.
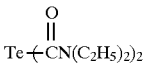
41.
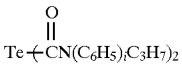
42.
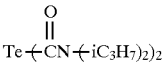
43.
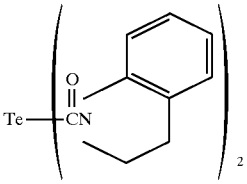
44.
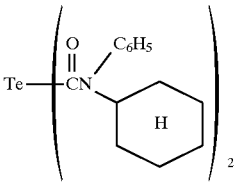
-continued
45.
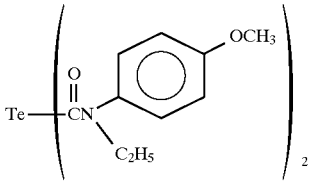
46.
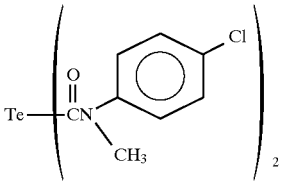
47.
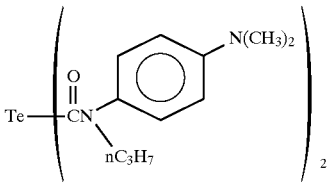
48.
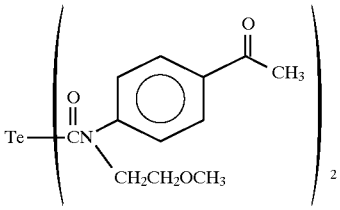
49.
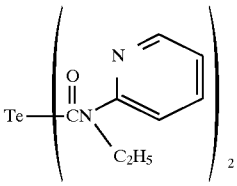
50.
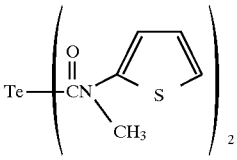
51.
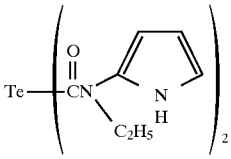
52.
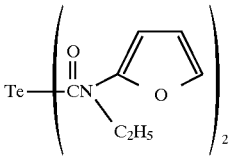

-continued

53.

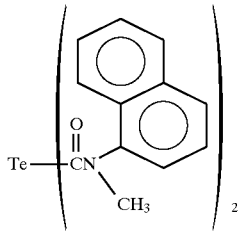

54.

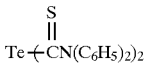

55.

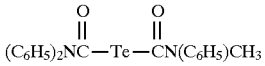

56.

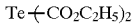

57.

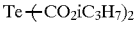

58.

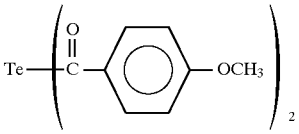

59.

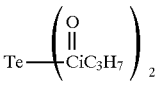

60.

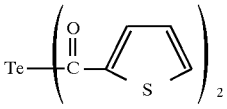

61.

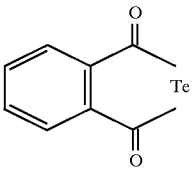

62.

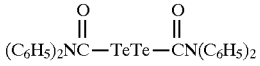

63.

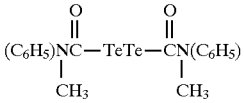

-continued

64.

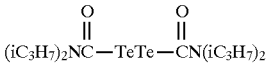

65.

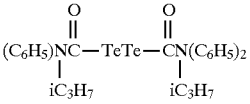

66.

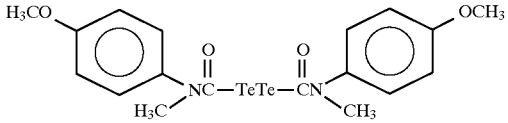

67.

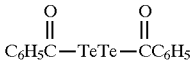

68.

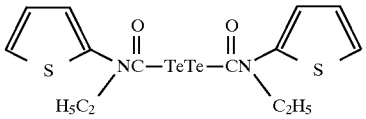

69.

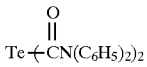

70.

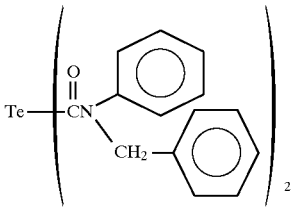

The tellurium sensitizers used in the present invention are compounds of the kind which can produce silver telluride, which is presumed to function as sensitizing nucleus, on the surface or inside of silver halide emulsion grains.

The production rate of silver telluride in a silver halide emulsion can be examined by the method described below.

When a tellurium sensitizer is added to a silver halide emulsion in a large amount (e.g., $1\times10^{-3}$ mole/mole Ag), the silver telluride produced shows its absorption in the visible region. Therefore, the method proposed for sulfur sensitizers by E. Moisar in *Journal of Photographic Science*, vol. 14, p. 181 (1966) and ibid., vol. 16, p. 102 (1968) can be applied to tellurium sensitizers. Specifically, that method consists in determining the quantity of silver sulfide produced in a silver halide emulsion by the use of the Kubelka-Munk function in which the concentration of silver sulfide in the emulsion is correlated with the infinite reflectivity of the emulsion in the visible region (at the wavelength of 520 nm), and so the relative production rate of silver telluride can be easily determined using the same method as the above. Further, since the foregoing reaction is seemingly comparable to the first-order reaction, the pseudo first-order kinetic constant thereof can be determined. For instance, a silver bromide emulsion having the crystal form of an octahedron and an average grain size of 0.5 μm (in which 0.75 mole of AgBr and 80 g of gelatin are contained per Kg of emulsion) is thermostated at 50° C. as the pH and the pAg thereof are maintained at 6.3 and 8.3, respectively, and thereto is added a tellurium compound dissolved in an organic solvent (e.g., methanol) in an amount of $1\times10^{-3}$ mole/mole Ag. The emulsion is placed in a cell having a thickness of 1 cm, and its reflectivity (R) at the wavelength of 520 nm was measured at regular intervals with a spectrophotometer equipped with an integrating sphere by reference to a blank emulsion. The pseudo first-order kinetic constant k ($min^{-1}$) can be evaluated by substituting the successively measured reflectivities in the Kubelka-Muck function $(1-R^2)/2R$ and examining changes in value of that function. Since R is constantly one (R=1) unless silver telluride is not produced, the value of the Kubelka-Muck function is kept at 0, which is the same as in the case of tellurium compound-free emulsions. As for the tellurium compounds used as a sensitizer, it is preferable in the present invention that they have a first-order kinetic constant k of from $1\times10^{-8}$ to $1\times10^{0}$ $min^{-1}$, measured under the same condition as the testing method described above.

When a tellurium sensitizer is added in such a reduced amount as to make it difficult to detect the absorption of silver telluride in the visible region, on the other hand, the silver telluride produced can be determined by separating it from the unreacted tellurium sensitizer. For instance, silver telluride is separated out by soaking the emulsion in an aqueous halide solution or an aqueous solution of a water-soluble mercapto compound, and then undergoes the quantitative analysis for a trace amount of tellurium according to atomic absorptiometry or the like. The reaction rate in this case varies greatly in the range of several orders of magnitude depending upon not only the type of the tellurium compound used but also the halide composition, the temperature, the pAg and the pH of an emulsion as the subject. The tellurium sensitizers used preferably in the present invention are those capable of producing silver telluride when they are added to a concrete silver halide emulsion having intended halide composition and crystal habit. In the present invention, there can be generally used to advantage such tellurium compounds as to produce silver telluride when they are added to a silver bromide emulsion which is under a temperature ranging from 40° C. to 95° C. or has its pH in the range of 3 to 10 or its pAg in the range of 6 to 11. Within this scope, the tellurium compounds which have their pseudo first-order kinetic constant k in the range of $1\times10^{-7}$ to $1\times10^{-1}$ $min^{-1}$, determined by the foregoing testing method are more preferred as tellurium sensitizers.

The present tellurium compounds represented by formulae (V), (VI) and (VII) can be synthesized according to conventional methods.

More specifically, they can be synthesized by the methods described in *J. Chem. Soc.* (*A*), 2927 (1969); *J. Organomet. Chem.*, 4, 320 (1965); ibid., 1, 200 (1963); ibid., 113 C35 (1976); *Phosphorus Sulfur*, 15, 155 (1983); *Chem. Ber.*, 109, 2996 (1976); *J. Chem. Soc. Chem. Commun.*, 635 (1980); ibid., 1102 (1979); ibid., 645 (1979); ibid., 820 (1987); *J. Chem. Soc. Perkin. Trans.*, 1, 2191 (1980); *The Chemistry of Organo Selenium and Tellurium Compounds* edited by S. Patai, vol. 2, pp. 216–267 (1987); *Tetrahedron Letters*, 31, 3587 (1990); *J. Chem. Res., Synopses*, 2, 56 (1990); *Bull. Chem. Soc. Japan*, 62, 2117 (1989); ibid., 60, 771 (1987); *J. Organometallic Chem.*, 338, 9 (1988); ibid., 306 C36 (1986); *Nippon Kagakukai Shi*, vol. 7, 1475 (1987); *Zeitschrift Chemie*, 26, 179 (1986); *Chemistry Letters*, 3, 475 (1987); *Indian Journal of Chemistry, Section A*, 25A, 57 (1986); *Angewandte Chemie*, 97, 1051 (1985); *Spectrochimica Acta, Part A*, 38A, 185 (1982); *Organic Preparations and Procedures International*, 10, 289 (1978); and *Organometallics*, 1, 470 (1982).

The amounts of selenium and tellurium sensitizers used in the present invention, though they depend on the conditions under which the silver halide grains are ripened chemically, are generally from $10^{-8}$ to $10^{-2}$ mole, preferably from $10^{-7}$ to $5\times10^{-3}$ mole, per mole of silver halide.

The chemical sensitization, although the present invention does not impose any particular restriction thereon, is generally carried out under a condition such that the peg is from 6 to 11, preferably from 7 to 10, and the temperature is from 40° to 95° C., preferably from 45° to 85° C.

It is preferable in the present invention that the above-described sensitizers be used together with precious metal sensitizers, such as gold, platinum, palladium and iridium. In particular, the combined use with gold sensitizers is preferred. Suitable examples of such gold sensitizers include chloroauric acid, potassium aurichlorate, potassium aurithiocyanate, auric sulfide and auric selenide. These gold sensitizers can be used in an amount of $10^{-7}$ to $10^{-2}$ mole per mole of silver halide.

Also, it is preferable for the above-described sensitizers to be further combined with sulfur sensitizers. As for the sulfur sensitizers which can be used, known unstable sulfur compounds including thiosulfates (e.g., hypo), thioureas (e.g., diphenyl thiourea, triethyl thiourea, allyl thiourea) and rhodanines are specific examples thereof. Such sulfur sensitizers can be used in an amount of $10^{-7}$ to $10^{-2}$ mole per mole of silver halide.

Furthermore, it is possible to use the present chemical sensitizers in combination with a reduction sensitizer. Specific examples of the reduction sensitizer which can be used include stannous chloride, aminoiminometasulfinic acid, hydrazine derivatives, borane compounds (e.g., dimethylamine borane), silane compounds and polyamine compounds.

It is preferable in the present invention to carry out the selenium sensitization or tellurium sensitization in the presence of a silver halide solvent.

Suitable examples of the silver halide solvent which can used for the foregoing purpose include thiocyanates (e.g., potassium thiocyanate), thioether compounds (e.g., compounds disclosed in U.S. Pat. Nos. 3,021,215 and 3,271,157, JP-B-58-30571 and JP-A-60-136736, specifically such as 3,6-dithia-1,8-octanediol), tetrasubstituted thiourea compounds (e.g., compounds disclosed in JP-B-59-11892 and U.S. Pat. No. 4,221,863, specifically such as tetramethylthiourea), thione compounds disclosed in JP-B-60-11341, mercapto compounds disclosed in JP-B-63-29727, meso ion compounds disclosed in JP-A-60-163042, selenoether compounds disclosed in U.S. Pat. No. 4,782,013, telluroether compounds disclosed in JP-A-2-118566, and sulfites. Of these compounds, thiocyanates, thioether compounds, tetrasubstituted thiourea compounds and thione compounds can be used to particular advantage. The silver halide solvents as cited above can be used in an amount of from $10^{-5}$ to $10^{-2}$ mole per mole of silver halide.

As for the silver halide emulsions used in the present invention, it is preferable for them to comprise silver chlorobromide or iodochlorobromide grains. The silver halide emulsion has preferably a silver chloride content of 50% by mole or more. The iodide content therein is preferably 3% by mole or less, more preferably 0.5% by mole or less. The foregoing silver halide grains may have any crystal shape, such as that of a cube, a tetradecahedron, an octahedron, amorphism or a plate. However, it is preferable for them to be cubic grains. The average grain size of the silver halide are preferably in the range of 0.1 to 0.7 μm, particularly preferably from 0.2 to 0.5 μm. As for the distribution of grain sizes, it is preferable that the distribution be so narrow as to correspond to a variation coefficient of 15% or less, preferably 10% or less, wherein the variation coefficient refers to the value obtained by dividing the standard deviation regarding the grain sizes of silver halide grains by the average grain size and then multiplying the quotient by 100.

The silver halide grains may be uniform throughout, or differ between the inner part and the surface layer.

Photographic emulsions used in the present invention can be prepared using methods described, e.g., in P. Glafkides, *Chemie et Physique Photographique*, Paul Montel, Paris (1967), G. F. Duffin, *Photographic Emulsion Chemistry*, The Focal Press, London (1966), V. L. Zelikman et al, *Making and Coating Photographic Emulsion*, The Focal Press, London (1964), and so on.

Suitable methods for reacting a water-soluble silver salt with a water-soluble halide include, e.g., a single jet method, a double jet method, or a combination thereof.

Also, a method in which silver halide grains are produced in the presence of excess silver ion (the so-called reverse mixing method) can be employed. On the other hand, the so-called controlled double jet method, in which the peg of the liquid phase wherein silver halide grains are to be precipitated is maintained constant, may be employed. Further, it is preferable to carry out the grain formation using the so-called silver halide solvent, such as ammonia, thioethers and tetrasubstituted thioureas. Preferably, tetrasubstituted thioureas are used as the silver halide solvent, which are disclosed in JP-A-53-82408 and JP-A-55-77737. As for the thioureas, tetramethylthiourea and 1,3-dimethyl-2-imidazolidinethione are preferably used.

According to the controlled double jet method and the grain formation method using a silver halide solvent, a silver halide emulsion having a regular crystal shape and a narrow distribution of grain sizes can be obtained with ease, and so these methods are useful for making the silver halide emulsions used in the present invention.

For the purpose of rendering the grain sizes uniform, it is also preferable that the grain growth is accelerated within the limits of critical saturation degree by using a method of changing the addition speed of silver nitrate or an alkali halide depending on the speed of grain growth, as disclosed in British Patent 1,535,016, JP-B-48-36890 and JP-B-52-16364, or a method of changing the concentrations of the aqueous solutions, as disclosed in British Patent 4,242,445 and JP-A-55-158124.

For attainment of high contrast and low fog density, it is desirable to incorporate at least one metal selected from rhodium and iridium into silver halide grains used in the silver halide photographic material of the present invention. The content of such a metallic compound is preferably from $1\times10^{-9}$ to $1\times10^{-5}$ mole, more preferably from $1\times10^{-8}$ to $5\times10^{-6}$ mole, per mole of silver. These metals may be used as a mixture of two or more thereof. The metals can be distributed evenly throughout the grains, or can be distributed in a specified pattern as disclosed in JP-A-63-29603, JP-A-2-306236, JP-A-3-167545, JP-A-4-76534, Japanese Patent Application Nos. 04-68305 and 04-258187.

The rhodium compounds which can be used in the present invention are water-soluble ones. Suitable examples thereof include rhodium(III) halides and rhodium complex salts containing as ligands halogen atoms, amines, oxalato groups or so on, such as hexachlororhodium(III) complex salts, hexabromorhodium(III) complex salts, hexaamminerhodium(III) complex salts and trioxalatorhodium(III) complex salts. In using these rhodium compounds, they are dissolved in water or an appropriate solvent. In order to stabilize the solution of a rhodium compound, a conventional method, that is, a method of adding an aqueous solution of hydrogen halogenide (e.g., hydrochloric acid, hydrobromic acid, hydrofluoric acid) or an alkali halide (e.g., KCl, NaCl, KBr, NaBr), can be adopted. Instead of using a water-soluble rhodium compound, it is possible to incorporate rhodium into emulsion grains by adding rhodium-doped silver halide grains to the silver halide preparation system and dissolving the grains therein.

Those compounds can be properly added at the time silver halide emulsion grains are formed, or at any stage prior to the emulsion coating. In particular, it is preferable for them to be added at the time the emulsion is formed, and thereby to be incorporated into silver halide grains.

As for the iridium compounds, various ones including, e.g., hexachloroiridium, hexaammineiridium, trioxalatoiridium and hexacyanoiridium salts can be used in the present invention. In using these iridium compounds, they are dissolved in water or an appropriate solvent. In order to stabilize the solution of an iridium compound, a conventional method, that is, a method of adding an aqueous solution of hydrogen halogenide (e.g., hydrochloric acid, hydrobromic acid, hydrofluoric acid) or an alkali halide (e.g., KCl, NaCl, KBr, NaBr), can be adopted. Instead of using a water-soluble iridium compound, it is possible to incorporate iridium into emulsion grains by adding iridium-doped silver halide grains to the silver halide preparation system and dissolving the grains therein.

The silver halide grains used in the present invention may be doped with rhenium, ruthenium or osmium.

In doping with such metal, the metal is added to an emulsion in the form of water-soluble complex salt disclosed in, for example, JP-A-63-2042, JP-A-1-285941, JP-A-2-20852, JP-A-2-20855. In particular, complexes having the coordination number of 6 and represented by the following formula are preferable:

$$[ML_6]^{-n}$$

wherein M represents Ru, Re or Os, L Represents a ligand, and n is 0, 1, 2, 3 or 4.

In this case, a counter ion is of no importance, so that an ammonium ion or an alkali metal ion is used as the counter ion.

As for the ligands, halides, cyanide, cyanate, nitrosyl or thionitrosyl ligands are suitable examples thereof. Specific examples of the metal complexes which can be used in the present invention are given below. However, the invention should not construed as being limited to these examples.

| | | |
|---|---|---|
| $[ReCl_6]^{-3}$ | $[ReBr_6]^{-3}$ | $[ReCl_5(NO)]^{-2}$ |
| $[Re(NS)Br_5]^{-2}$ | $[Re(NO)(CN)_5]^{-2}$ | $[Re(O)_2(CN)_4]^{-3}$ |
| $[RuCl_6]^{-3}$ | $[RuCl_4(H_2O)_2]^{-2}$ | $[RuCl_5(NO)]^{-2}$ |
| $[RuBr_5(NS)]^{-2}$ | $[Ru(CN)_6]^{-4}$ | $[Ru(CO)_3Cl_3]^{-2}$ |
| $[Ru(CO)Cl_5]^{-2}$ | $[Ru(CO)Br_5]^{-2}$ | |
| $[OsCl_5]^{-3}$ | $[OsCl_5(NO)]^{-2}$ | $[Os(NO)(CN)_5]^{-2}$ |
| $[Os(NS)Br_5]^{-2}$ | $[Os(CN)_6]^{-4}$ | $[Os(O)_2(CN)_4]^{-4}$ |

The addition of these metal complexes can be properly carried out at the time silver halide emulsion grains are formed, or at any stage prior to the emulsion coating. In particular, it is preferable for them to be added at the time the emulsion is formed, and thereby to be incorporated into silver halide grains.

In order to incorporate such a metal complex as cited above into silver halide grains by adding it during the grain formation, there can be adopted the method of adding in advance a solution prepared by dissolving in water the metal complex powder or its mixture with NaCl or KCl to either a water-soluble salt solution or a water-soluble halide solution for the grain formation; the method of forming silver halide grains by simultaneously admixing three solutions, namely a silver salt solution, a halide solution and the foregoing metal complex powder-containing solution as the third solution; or the method of pouring a water solution of the metal complex in a desired amount into the reaction vessel under grain formation. In particular, it is preferable to adopt the method of adding to an aqueous halide solution a solution prepared by dissolving in water the metal complex powder together with NaCl or KCl.

In order to make such a metal complex adsorb to the grain surface, an aqueous solution thereof may be poured into the reaction vessel in a required amount just after the grain formation, during or at the conclusion of physical ripening, or at the time of chemical ripening.

Silver halide grains used in the present invention may be doped by other heavy metal salts. In particular, the doping of a Fe complex salt, such as $K_4[Fe(CN)_6]$, is preferred.

Further, the silver halide grains used in the present invention may contain metal atoms, such as cobalt, nickel, palladium, platinum, gold, thallium, copper and lead. These metals are preferably used in an amount of from $1\times10^{-9}$ to $1\times10^{-4}$ mole per mole of silver halide. The metals can be contained in the grains by the addition in the form of metal salt, including single, double and complex salts, during the grain formation.

As for the binder or the protective colloid of photographic emulsions, gelatin is preferably used. Also, there can be used hydrophilic colloids other than gelatin, with specific examples including gelatin derivatives, graft polymers prepared from gelatin and other high polymers, proteins such as albumin and casein, cellulose derivatives such as hydroxyethyl cellulose, carboxymethyl cellulose and cellulose sulfate, sugar derivatives such as sodium alginate, and starch derivatives, and various kinds of synthetic hydrophilic high molecular substances including homo- and copolymers such as polyvinyl alcohol, polyacrylic acid, polymethacrylic acid, polyacrylamide, polyvinylimidazole and polyvinyl butyral.

Examples of a support used in the photographic material of the present invention include flexible supports such as natural or synthetic papers laminated with α-olefin polymers (e.g., polyethylene, polypropylene, ethylene/butene copolymers), and metallic supports. In particular, a polyethylene terephthalate film is preferably used. As for the subbing layer used in the present invention, there can be instanced the subbing layer provided by the treatment with an organic solvent including polyhydroxybenzenes disclosed in JP-A-49-3972, and the subbing layer of aqueous latex type disclosed in JP-A-49-11118 and JP-A-52-10491. In general, the surface of such a subbing layer can further undergo a certain chemical or physical processing. Such a treatment includes surface activating processing, such as processing with chemicals, mechanical processing, a corona discharge processing and so on.

Detailed description of the developer used in the present invention is given below.

The developer of the present invention, as stated above, does not contain, in a substantial sense, dihydroxybenzenes as a developing agent, but contains the compound represented by formula (I) as a main developing agent. In addition, it is preferable that the developer of the present invention contain 1-phenyl-3-pyrazolidones and/or p-aminophenols as auxiliary developing agents.

The compound represented by formula (I) which is used as developing agent in the present invention is illustrated below in detail.

In formula (I), $R_1$ and $R_2$ are the same or different and each represents a hydroxyl group, an amino group (which may be substituted by one or more alkyl groups having from 1 to 10 carbon atoms, such as methyl, ethyl, n-butyl and hydroxyethyl), an acylamino group (e.g., acetylamino, benzoylamino), an alkylsulfonylamino group (e.g., methanesulfonylamino), an arylsulfonylamino group (e.g., benzenesulfonylamino, p-toluenesulfonylamino), an alkoxysulfonylamino group (e.g., methoxysulfonylamino), a mercapto group, or an alkylthio group (e.g., methylthio, ethylthio). Of these groups, a hydroxyl group, an amino group, an alkylsulfonylamino group and an arylsulfonylamino group are preferred as $R_1$ and $R_2$.

P and Q are the same or different and each represents a hydroxyl group, a hydroxyalkyl group, a carboxyl group, a carboxyalkyl group, a sulfo group, a sulfoalkyl group, an amino group, an aminoalkyl group, an alkyl group, an alkoxy group, an aryl group or a mercapto group, or P and Q represent atoms capable of forming a 5- to 8-membered ring by combined with each other and further by associating with two vinyl carbons to which $R_1$ and $R_2$ are attached respectively and one carbon atom to which Y is attached. As for the ring formed, those completed by combining moieties chosen from —O—, —C($R_4$)($R_5$)—, —C($R_6$)=, —C(=O)—, —N($R_7$)- and —N= are examples thereof. Herein, $R_4$, $R_5$, $R_6$ and $R_7$ each represents a hydrogen atom, an alkyl group having from 1 to 10 carbon atoms, which may have a substituent (e.g., hydroxyl, carboxyl, sulfo), an aryl group having from 6 to 15 carbon atoms, which may have a substituent (e.g., alkyl, halogen, hydroxyl, carboxyl, sulfo), a hydroxyl group or a carboxyl group. Further, the foregoing 5- to 8-membered ring may be fused together with a saturated or unsaturated ring to form a condensed ring.

Specific examples of such a 5- to 8-membered ring include a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring and a uracil ring. Preferred examples of the 5- to 8-membered rings include a dihydrofuranone ring, a cyclopentenone ring, a cyclohexenone ring, a pyrazolinone ring, an azacyclohexenone ring and a uracil ring.

Y represents =O or =N—$R_3$. Herein, $R_3$ represents a hydrogen atom, a hydroxyl group, an alkyl group (e.g., methyl, ethyl), an acyl group (e.g., acetyl), a hydroxyalkyl group (e.g., hydroxymethyl, hydroxyethyl), a sulfoalkyl group (e.g., sulfomethyl, sulfoethyl) or a carboxyalkyl group (e.g., carboxymethyl, carboxyethyl).

Specific examples of the compounds represented by formula (I) are illustrated below. However, the invention should not be construed as being limited to these examples.

I-1

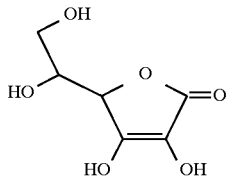

-continued
I-2
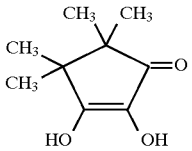
I-3
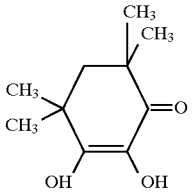
I-4
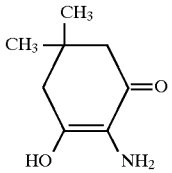
I-5
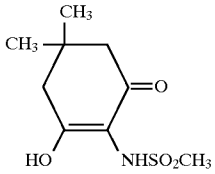
I-6
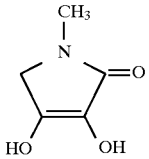
I-7
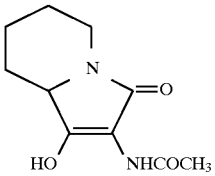
I-8
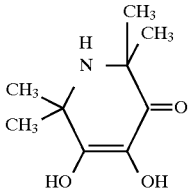
I-9
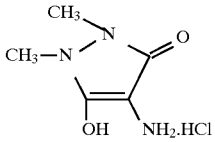
I-10
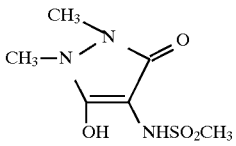
-continued
I-11
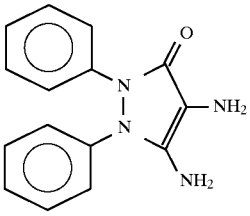
I-12
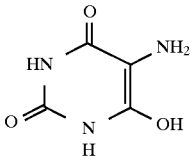
I-13
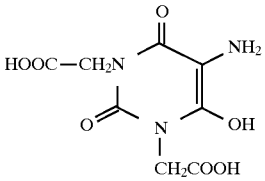
I-14
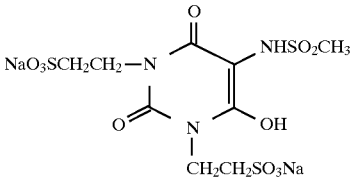
I-15
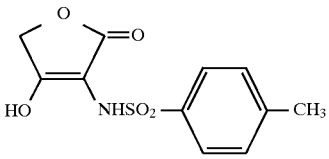
I-16
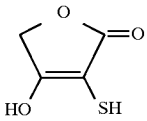
I-17
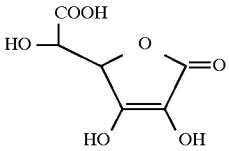
I-18
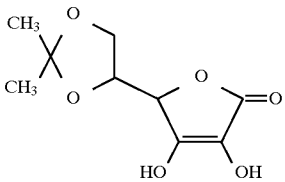
I-19
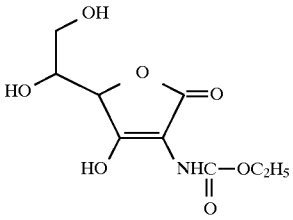

-continued

I-20

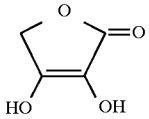

I-21

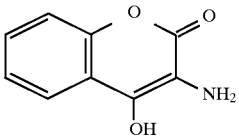

I-22

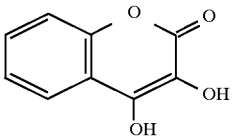

I-23

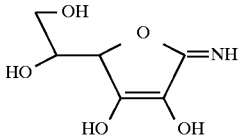

I-24

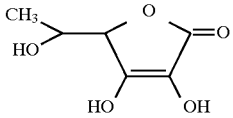

I-25

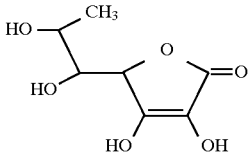

I-26

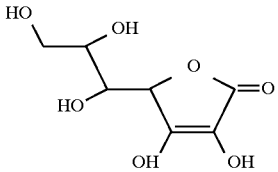

I-27

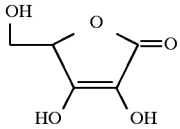

I-28

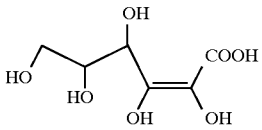

I-29

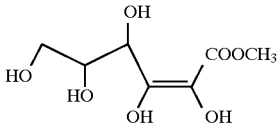

I-30

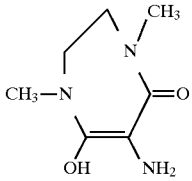

-continued

I-31

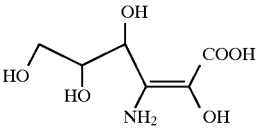

Of these compounds, ascorbic acid or its stereoisomer (erythorbic acid), i.e., Compound I-1, is preferred.

The compound represented by formula (I) is generally used in an amount of from $5\times10^{-3}$ to 1 mole, more preferably from $10^{-2}$ to 0.5 mole, per liter of developer.

Specific examples of 1-phenyl-3-pyrazolidones and the derivatives thereof used as an auxiliary developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxylmethyl-3-pyrazolidone, 1-phenyl-5-methyl-3-pyrazolidone, 1-p-aminophenyl-4,4-dimethyl-3-pyrazolidone, and 1-p-tolyl-4-methyl-4-hydroxymethyl-3-pyrazolidone.

Specific examples of the p-aminophenols used as an auxiliary developing agent include N-methyl-p-aminophenol, p-aminophenol, N-(β-hydroxyethyl)-p-aminophenol, N-(4-hydroxyphenyl)glycine, 2-methyl-p-aminophenol and p-benzylaminophenol. Of these compounds, N-methyl-p-aminophenol is preferred.

When the 1-phenyl-3-pyrazolidones or p-aminophenols as cited above are used in combination with the compound represented by formula (I), it is preferable that the amount thereof is from $10^{-3}$ to 0.1 mole/l, and more preferably $10^{-3}$ to 0.06 mole/l.

The expression "containing no dihydroxybenzenes developing agent" as used in the present invention means that the concentration of dihydroxybenzenes in the developer is negligible, compared with those of the compound represented by formula (I) and the foregoing auxiliary developing agents (for example, $5\times10^{-4}$ mole/l or less). It is preferable for the developer of the present invention to be completely free from dihydroxybenzenes.

To the developer of the present invention, there may be added sulfites as preservatives, such as sodium sulfite, potassium sulfite, lithium sulfite, sodium hydrogen sulfite, potassium metabisulfite and formaldehyde sodium bisulfite. Such sulfites are used in an amount of 0.01 mole/l or more. However, the addition amount thereof should be minimized so far as it can satisfy the need. This is because the addition thereof in a large amount causes the dissolution of silver halide emulsion grains to generate silver stain, and further it is responsible for raising COD (chemical oxygen demand).

The pH of the developer used for the development-processing of the present invention is preferably from 10.0 to 12.0, and more preferably from 10.4 to 12.0. The pH values higher than 12.0 are undesirable because the non-image area suffers a sudden increase in stain, or black spots. When the developer has pH of lower than 10.0, on the other hand, satisfactorily high contrast cannot be achieved.

Suitable examples of alkali agents used for pH adjustment include sodium hydroxide, potassium hydroxide, sodium carbonate and potassium carbonate.

In the developer of the present invention, pH buffers such as the sugars disclosed in JP-A-60-93433 (e.g., saccharose), oximes (e.g., acetoxime), phenols (e.g., 5-sulfosalicylic acid), silicates, sodium tertiary phosphate and potassium tertiary phosphate can be used. The concentration of the pH buffers is preferably 0.3 mole/l or less. However, it is undesirable to use boron compounds, including boric acid and sodium metaborate, as the pH buffers of the present developer because there is a risk that they react with the compound of the present invention represented by formula (I) to deactivate it.

The developer of the present invention may further contain development restrainers such as potassium bromide, potassium iodide, etc., organic solvents such as ethylene glycol, diethylene glycol, triethylene glycol, dimethylformamide, methyl cellosolve, hexylene glycol, ethanol, methanol, etc., antifoggants including indazole compounds such as 5-nitroindazole, etc., benzimidazole compounds such as sodium 2-mercaptobenzimidazole-5-sulfonate, etc., and benzotriazole compounds such as 5-methylbenzotriazole, etc., and the development accelerators described in *Research Disclosure*, Vol. 176, No. 17643, Item XXI (December, 1978). Also, it may contain the amine compounds disclosed in U.S. Pat. No. 4,269,929, JP-A-61-267759 and JP-A-2-208652. Further, it may contain toning agents, surfactants, hardeners and so on, if needed.

Furthermore, the amino compounds, including alkanolamines, disclosed in EP-A-0136582, British Patent 958,678, U.S. Pat. No. 3,232,761 and JP-A-56-106244 can be used in the developer of the present invention for the purposes of accelerating the development and increasing the contrast.

The fixer used in the present invention is an aqueous solution containing a thiosulfate, and the pH thereof is 3.8 or more, preferably from 4.2 to 7.0.

As for the fixing agent, sodium thiosulfate and ammonium thiosulfate are examples thereof. In particular, ammonium thiosulfate is preferable from the viewpoint of fixing speed. The amount of the fixing agent can be properly chosen, and it is generally set in the range of about 0.1 to about 6 mole per liter.

The fixer may contain a water-soluble aluminum salt as a hardener. Suitable examples of such an aluminum salt include aluminum chloride, aluminum sulfate and potassium alum.

In the fixer, tartaric acid, citric acid, gluconic acid or derivatives thereof can be used alone or as a mixture of two or more thereof. These acids are effective when added in an amount of 0.005 mole or more, preferably from 0.01 to 0.03 mole, per liter of fixer.

Further, the fixer can optionally contain preservatives (e.g., sulfites, hydrogen sulfites), pH buffers (e.g., acetic acid, boric acid), pH adjusters (e.g., sulfuric acid, ammonia), chelating agents having an ability to soften hard water, surfactants, wetting agents, fixation accelerators, and the compounds disclosed in JP-A-62-78551.

As for the fixation accelerators, the thiourea derivatives disclosed in JP-A-45-35754, JP-A-58-122535 and JP-A-58-122536, triple bond-containing alcohols and the thioether compounds disclosed in U.S. Pat. No. 4,126,459 are examples thereof. Also, the compounds disclosed in JP-A-2-44355 may be used as fixation accelerators.

Furthermore, the fixer can contain as a dye elution accelerator the compounds disclosed in JP-A-64-4739.

In the photographic processing method of the present invention, the photographic material is processed with washing water or a stabilizing solution after the development and fixation steps, and then dried. It is possible to perform the washing or stabilizing step using washing water or a stabilizing solution at a replenishment rate of at most 3 liter of a replenisher per $m^2$ of silver halide photographic material (including the replenishment rate of zero, namely the washing with stored water). That is, not only economizing water in the washing step but also making a piping work unnecessary in setting up an automatic developing machine becomes possible.

As a method for reduction in replenishment of washing water, the multistage (e.g., two-stage or three-stage) counter current process has been known for a long time. If this process is applied to the present invention, the fixation-processed photographic material is processed as it is brought into contact with successive, more and more cleaned processing solutions, that is, processing solutions less and less contaminated with the fixer. Accordingly, more efficient washing can be carried out.

When the washing step is performed with a small amount of water, it is preferable to use a washing tank equipped with squeeze rollers or crossover rollers, as disclosed in JP-A-63-18350 and JP-A-62-287252. Further, the addition of various kinds of oxidizing agents and the filtration may be supplemented for the purpose of reduction in pollution load. An increase in pollution load is a big problem that the washing with little water faces.

In the water-saved or pipeless processing, it is preferable that some means of proofing against molds are applied to the washing water or stabilizing solution.

Examples of means of proofing against molds include the ultraviolet irradiation method described in JP-A-60-263939, the magnetic field-using method described in JP-A-60-263940, the method of using water purified with an ion exchange resin described in JP-A-61-131632 and the method of using antibacteria disclosed in JP-A-62-115154, JP-A-62-153952, JP-A-62-220951 and JP-A-62-209532.

Further, the foregoing methods can be used in combination with antibacteria, antimolds, surfactants and so on described, e.g., in L. F. West, "Water Quality Criteria", *Photo. Sci. & Eng.*, Vol. 9, No. 6 (1965); M. W. Reach, "Microbiological Growths in Motion Picture Processing", *SMPTE Journal*, Vol. 85 (1976); R. O. Deegan, "Photo Processing Wash Water Biocides", *J. Imaging Tech.*, Vol. 10, No. 6 (1984); JP-A-57-8542, JP-A-57-56143, JP-A-58-105145, JP-A-57-132146, JP-A-58-18631, JP-A-97530, and JP-A-57-157244.

Furthermore, the washing or stabilizing bath can contain as microbiocides the isothiazolidine compounds described in R. T. Kreiman, *J. Imaging Tech.*, 10(6), p. 242 (1984); the compounds disclosed in *Research Disclosure*, Vol, 205, No. 20526 (1981, No. 4).

In addition, the bath may contain the compounds as described in Hiroshi Horiguchi, *Bohkin Bohbai no Kagaku* (which means "Antibacterial and Moldproof Chemistry"), Sankyo Shuppan (1982), and *Bohkin Bohbai Gijutsu Handbook* (which means "Handbook of Antibacterial and Moldproof arts), Nippon Bohkin Bohbai Gakkai (1986).

When the washing is carried out with a small amount of water in the present method, it is also preferable that the constitution of the washing process disclosed in JP-A-63-143548 be adopted.

In the present invention also, part or all of the overflow generated from the washing or stabilizing bath by replenishing the bath with the water, which is rendered moldproof by the above-cited means, in proportion as the processing proceeds can be used in the prior step wherein the processing solution having a fixability is used, as described in JP-A-60-235133.

In the development processing of the present invention, it is preferable that the development time is from 5 seconds to 3 minutes, more preferably from 8 seconds to 2 minutes, and the development temperature is from 18° C. to 50° C., preferably from 24° C. to 40° C.

As for the fixation processing, it is preferable that the fixation time is from 5 seconds to 3 minutes at a temperature of from 18° C. to 50° C. More preferably, the fixation time and temperature is from 6 seconds to 2 minutes and from 24° C. to 40° C., respectively. Sufficient fixation can be effected within the above-described temperature and time ranges, and so the sensitizing dyes can be eluted to such an extent as not to generate color stains.

The temperature and time in the washing or stabilizing step are preferably from 5° C. to 50° C. and from 6 seconds to 3 minutes, respectively, and it is more preferable for them to be from 15° C. to 40° C. and from 8 seconds to 2 minutes, respectively.

The developed, fixed and washed (or stabilized) photographic materials are dried after being passed between a pair of squeeze rollers. They are dried at a temperature of from 40° C. to 100° C. Though it can be properly varied depending on the surrounding condition, the drying time is generally from 4 seconds to 3 minutes. In particular, it is preferable for them to be dried at a temperature of from 40° C. to 80° C. for a time of from 5 seconds to 1 minute.

In performing the photographic processing on condition that the dry-to-dry time is 100 seconds or less, it is preferable to take the following means for prevention of developer mark characteristic of rapid processing. That is, there are adopted such means that the rubber rollers disclosed in JP-A-63-151943 are employed as rollers fixed on the exit of the developing tank; the speed of jetting the developer components into the developing tank is set at 10 m/min or more in order to vigorously agitate the developer, as disclosed in JP-A-63-151944; and the developer is more vigorously agitated at least during development-processing than under standing-by, as disclosed in JP-A-63-264758. For achieving more rapid processing, it is particularly desirable that rollers installed in a fixing tank be constructed of counter rollers to accelerate the fixation speed. Owing to the counter-roller construction, the rollers can be reduced in number and the fixing tank can be diminished in size. That is, it becomes possible to make an automatic developing machine more compact.

The image formation method according to the present invention can achieve especially good results in such a system that a hydrazine derivative as a nucleating agent, which urges the system to produce an image of ultra-high contrast, is contained in the silver halide emulsion layer as described above or other hydrophilic colloid layers. As for the hydrazine derivative, already known compounds can be used. Specifically, the hydrazine compounds represented by the following formula (II) can be preferably used:

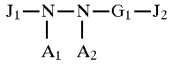

$$J_1-\underset{\underset{A_1}{|}}{N}-\underset{\underset{A_2}{|}}{N}-G_1-J_2 \qquad \text{(II)}$$

wherein $J_1$ represents an aliphatic or aromatic group; $J_2$ represents a hydrogen atom, an alkyl group, an aryl group, an unsaturated heterocyclic group, an alkoxy group, an aryloxy group, an amino group, a hydrazino group, a carbamoyl group or an oxycarbonyl group; $G_1$ represents —CO—, —$SO_2$—, —SO—, —$(J_3)P(=O)$—, —CO—CO—, a thiocarbonyl group or an iminomethylene group, wherein $J_3$ has the same meaning as $J_2$, but it may be different from $J_2$; and $A_1$ and $A_2$ are both a hydrogen atom, or one of $A_1$ and $A_2$ is a hydrogen atom and the other is a substituted or unsubstituted alkylsulfonyl group, a substituted or unsubstituted arylsulfonyl group, or a substituted or unsubstituted acyl group.

In the above formula (II), the aliphatic group represented by $J_1$ includes those having from 1 to 30 carbon atoms. In particular, straight-chain, branched or cyclic alkyl groups having from 1 to 20 carbon atoms are preferred as $J_1$. These alkyl groups may have substituent groups.

The aromatic group represented by $J_1$ in formula (II) is a monocyclic or dicyclic aryl group or an unsaturated heterocyclic group. The unsaturated heterocyclic group herein may include those formed by fusing it together with aryl groups.

$J_1$ is preferably an aryl group, more preferably one which contains a benzene ring.

The aliphatic or aromatic group represented by $J_1$ may have one or more substituents. Typical examples of such substituents include an alkyl group, an aralkyl group, an alkenyl group, an alkinyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphonamido group, a diacylamino group, an imido group, and $J_4$-NHCON($J_5$)—CO— (wherein $J_4$ and $J_5$ are chosen from the groups defined as $J_2$, and they may be the same or different). Of these groups, an alkyl group (preferably one having from 1 to 20 carbon atoms), an aralkyl group (preferably one having from 7 to 30 carbon atoms), an alkoxy group (preferably one having from 1 to 20 carbon atoms), a substituted amino group (preferably an amino group substituted with at least one alkyl group having from 1 to 20 carbon atoms), an acylamino group (preferably one having from 2 to 30 carbon atoms), a sulfonamido group (preferably one having from 1 to 30 carbon atoms), a ureido group (preferably one having from 1 to 30 carbon atoms) and a phosphonamido group (preferably one having from 1 to 30 carbon atoms) are preferred in particular. The groups cited above may further be substituted.

As for the alkyl group represented by $J_2$ in formula (II), an alkyl group having from 1 to 4 carbon atoms is preferred; while a monocyclic or dicyclic aryl group (e.g., one which contains a benzene ring) is preferred as the aryl group represented by $J_2$.

When $G_1$ represents —CO—, it is preferable for $J_2$ to represent a hydrogen atom, an alkyl group (e.g., methyl, trifluoromethyl, 3-hydroxypropyl, 3-methanesulfonamidopropyl, phenylsulfonylmethyl), an aralkyl group (e.g., o-hydroxybenzyl) or an aryl group (e.g., phenyl, 3,5-dichlorophenyl, o-methanesulfonamidophenyl, 4-methanesulfonylphenyl, 2-hydroxymethylphenyl). A hydrogen atom is more preferred.

The group represented by $J_2$ may have one or more substituents. Suitable examples of such substituents include those recited above with respect to $J_1$.

As for the $G_1$ in formula (II), the group —CO— is most preferred.

Also, $J_2$ may be a group such that it can split the $G_1$-$J_2$ moiety off the residual molecule and thereby cause the cyclization reaction to form a cyclic structure containing the atoms of the $G_1$-$J_2$ moiety. Specific examples of such a group include those disclosed in JP-A-63-29751.

$A_1$ and $A_2$ are most preferably a hydrogen atom.

Moreover, $J_1$ or $J_2$ in formula (II) may be a group into which a ballast group used commonly in immobile photographic additives, such as couplers, etc., or a polymeric moiety is introduced. The ballast group is a group containing 8 or more carbon atoms and having a relatively slight influence upon photographic properties, and it can be chosen from among an alkyl group, an alkoxy group, a phenyl group, an alkylphenyl group, a phenoxy group, an alkylphenoxy group and the like. As for the polymeric moiety, those disclosed in JP-A-1-100530 are examples thereof.

Further, $J_1$ or $J_2$ in formula (II) may be a group into which a group capable of intensifying the adsorption onto the grain surface of silver halide is introduced. Specific examples of such an adsorption-intensifying group include the thiourea groups, the heterocyclic thioamido groups, the mercapto heterocyclic groups and the triazole groups disclosed in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-270948, JP-A-63-234244, JP-A-63-234245 and JP-A-63-234246.

In formula (II), at least either $J_1$ or $J_2$ contains preferably a ballast group or a group capable of intensifying the adsorption onto the grain surface of silver halide. In particular, the compounds in which $J_1$ contains a trialkylammonium group, those in which $J_1$ contains an alkylthio (including cycloalkylthio) group or an arylthio group, and those in which the carbon atom contained in $J_2$ and bonded to $G_1$ is substituted with an electron withdrawing group are more preferred.

Specific examples of the compound represented by formula (II) are illustrated below. However, the invention should not be construed as being limited to these examples.

II-1

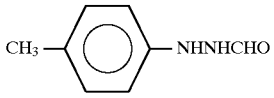

II-2

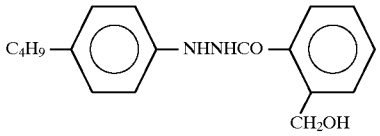

II-3

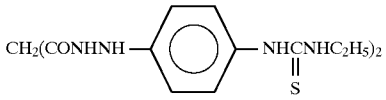

II-4

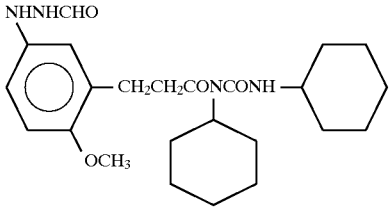

II-5

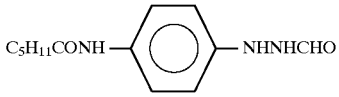

II-6

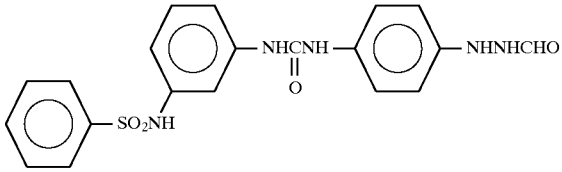

II-7

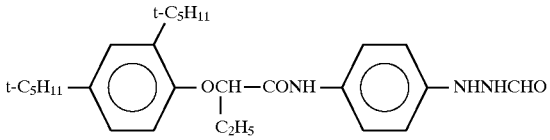

II-8

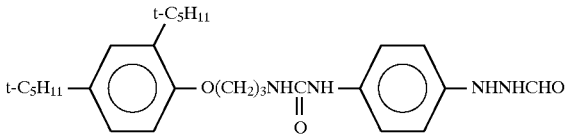

II-9

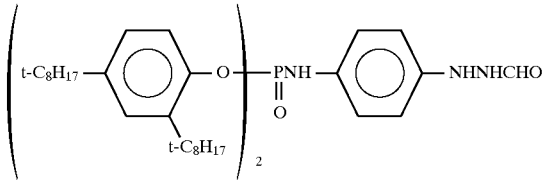

-continued
II-10
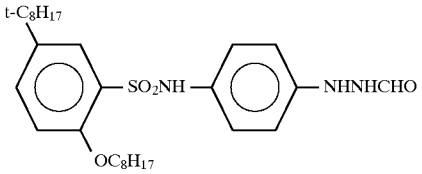
II-11
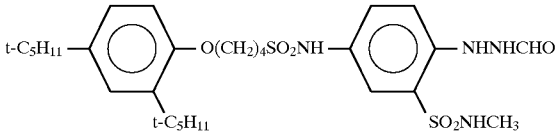
II-12
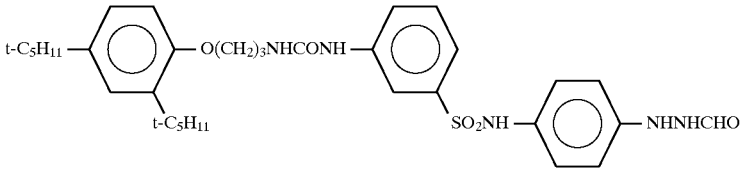
II-13
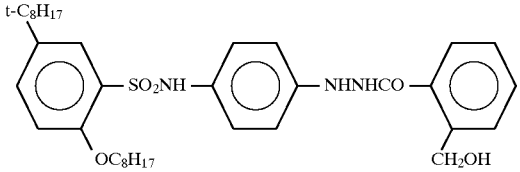
II-14
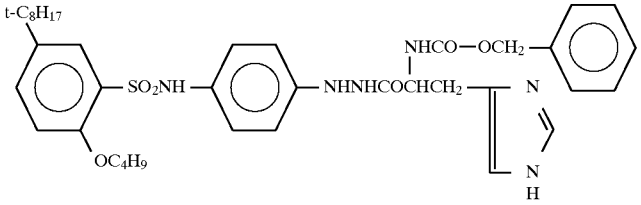
II-15
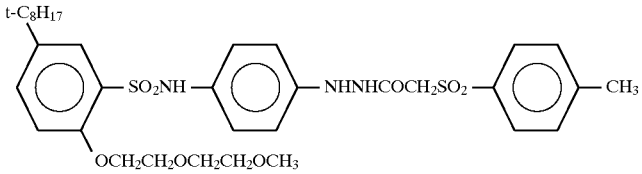
II-16
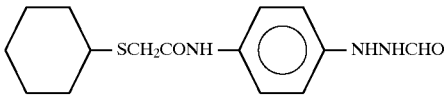
II-17
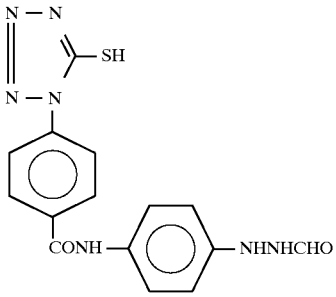

-continued
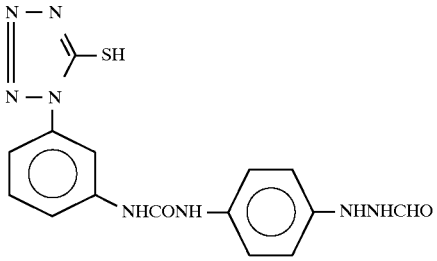
II-18
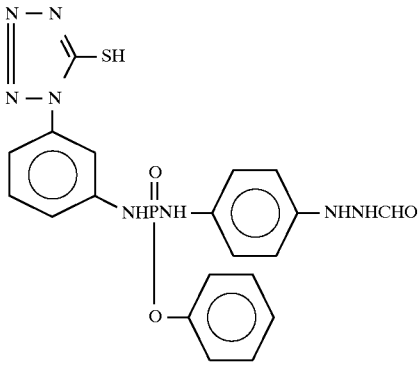
II-19
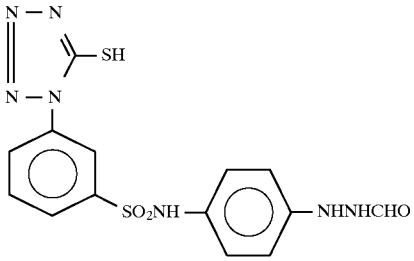
II-20
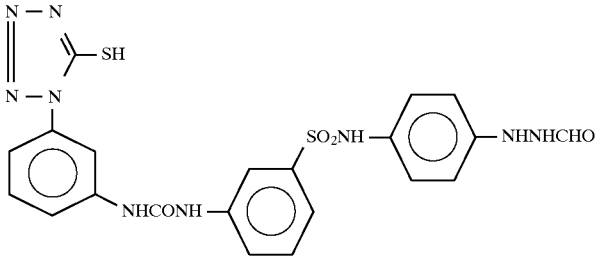
II-21
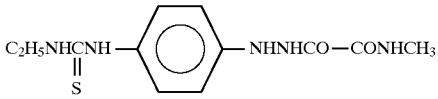
II-22
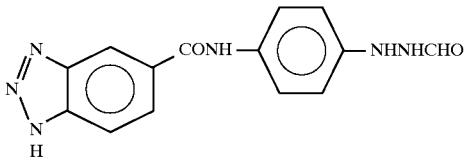
II-23
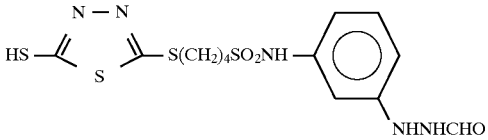
II-24

-continued
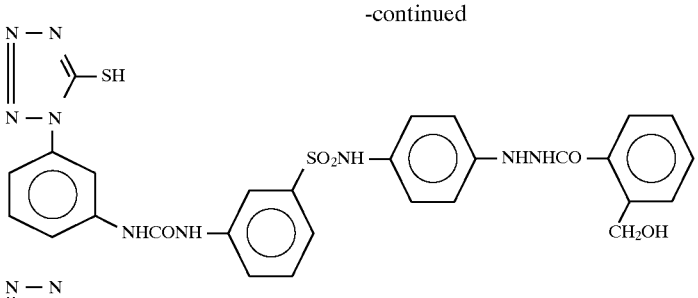
II-25
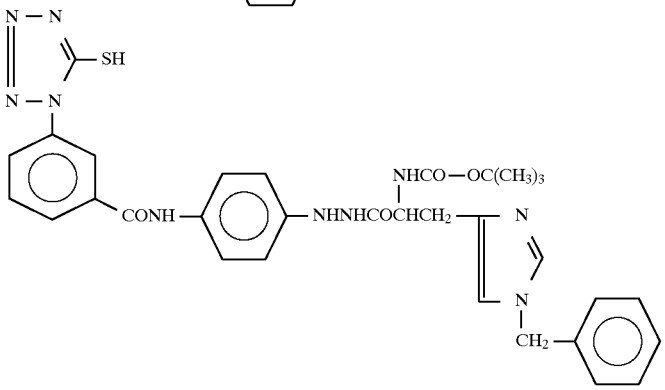
II-26
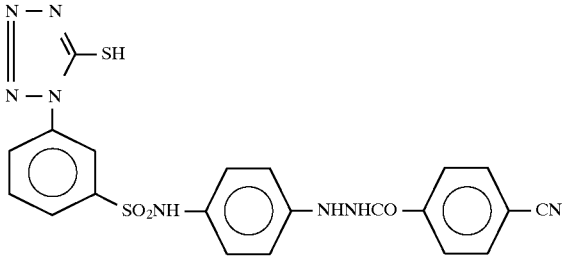
II-27
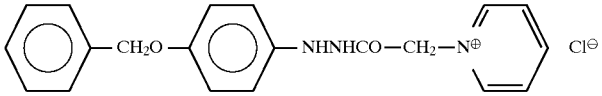
II-28
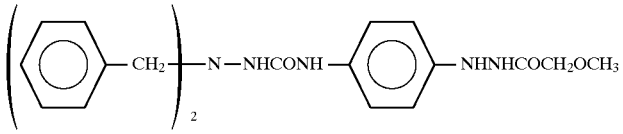
II-29
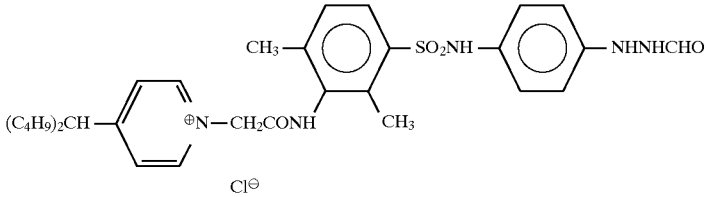
II-30
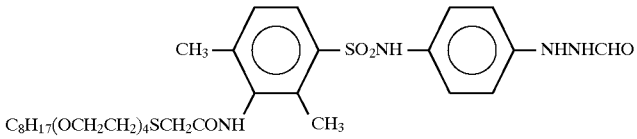
II-31
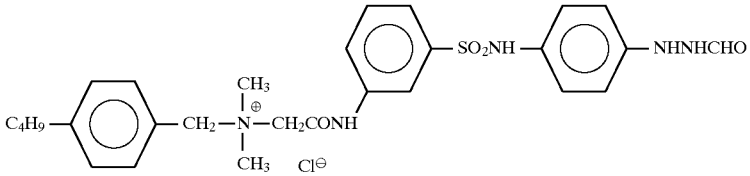
II-32

-continued
II-33
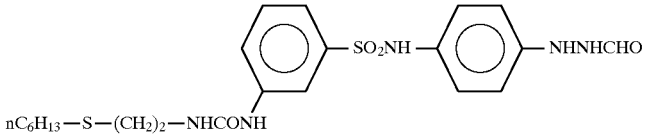
II-34
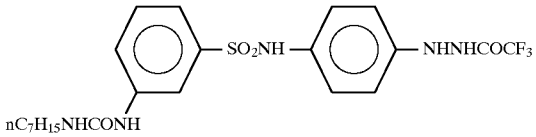
II-35
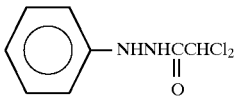
II-36
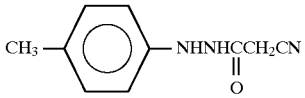
II-37
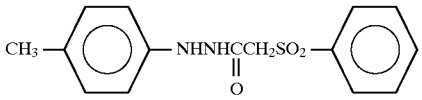
II-38
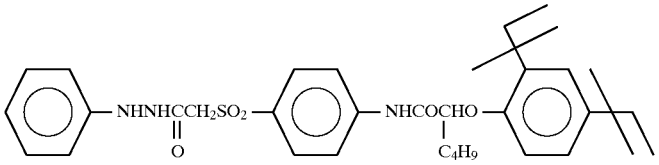
II-39
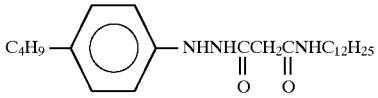
II-40
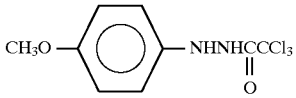
II-41
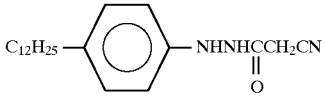
II-42
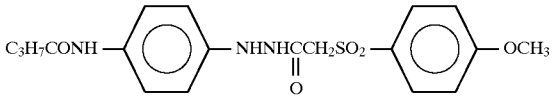
II-43
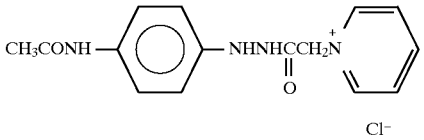
II-44
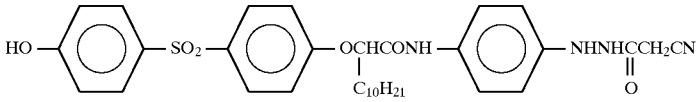

-continued
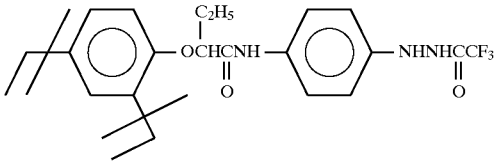
II-45
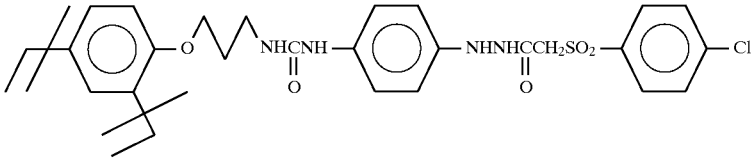
II-46
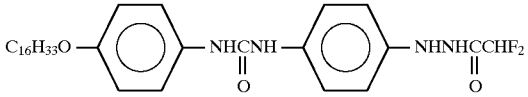
II-47
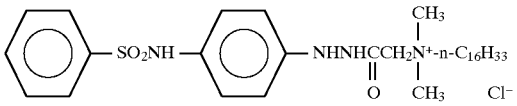
II-48
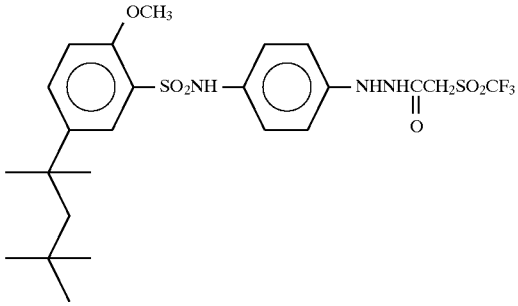
II-49
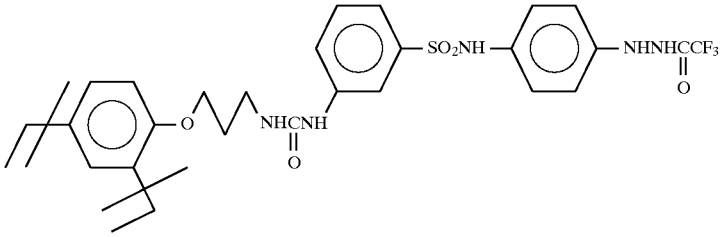
II-50
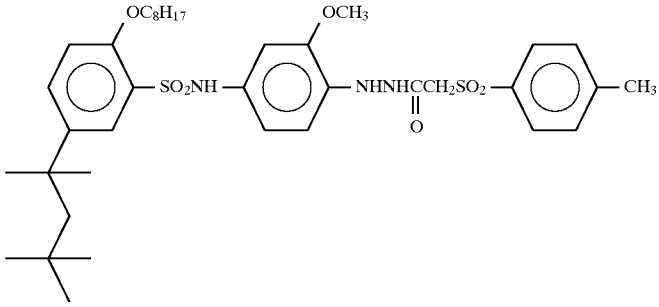
II-51
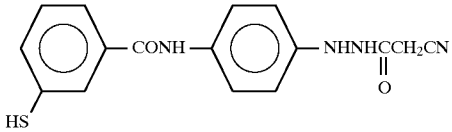
II-52

-continued
II-53
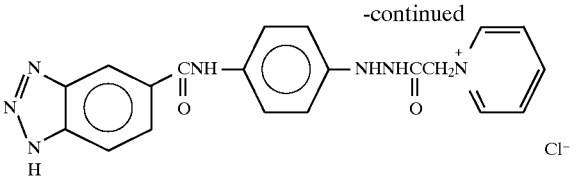
II-54
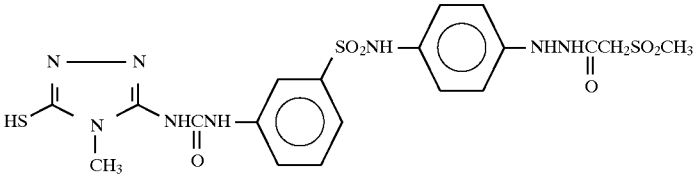
II-55
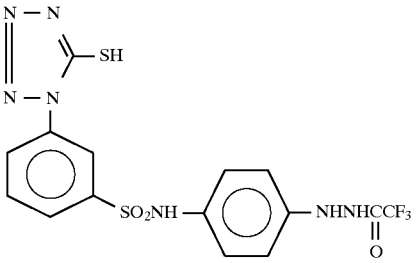
II-56
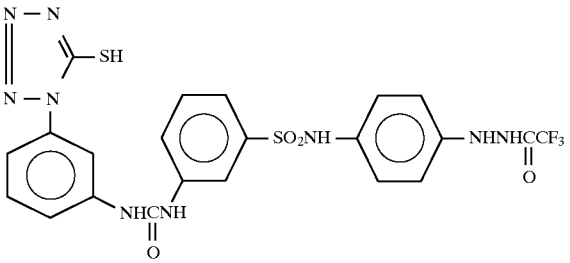
II-57
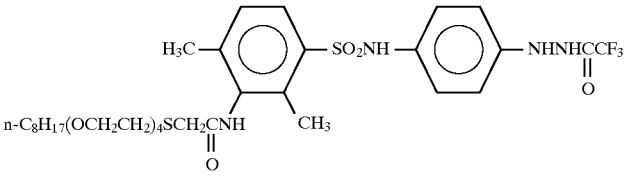
II-58
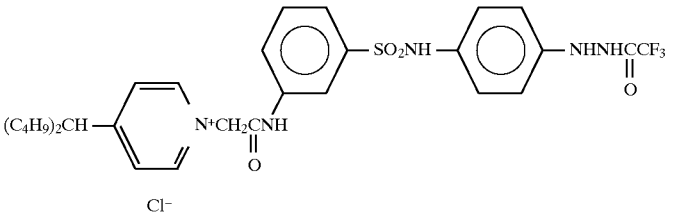
II-59
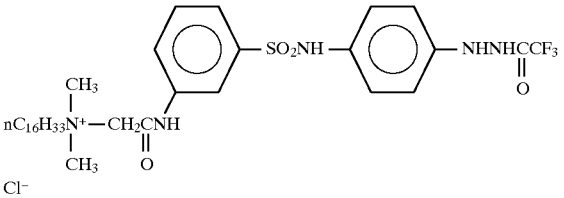
II-60
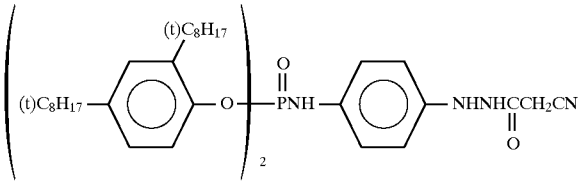

-continued
II-61
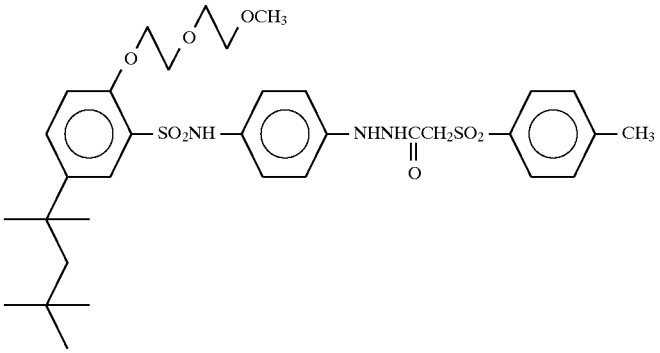
II-62
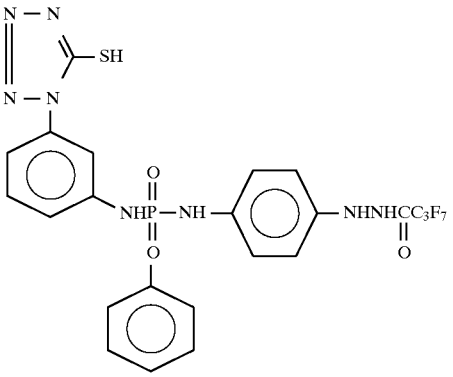
II-63
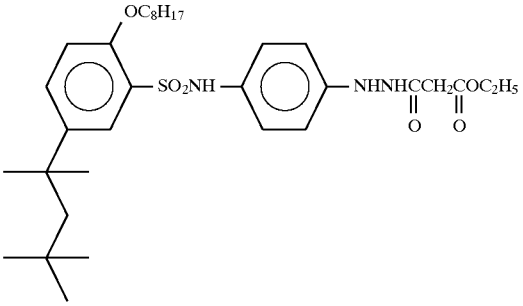
II-64
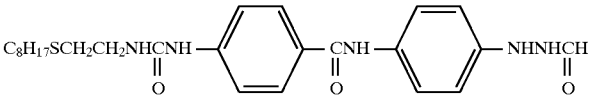
II-65
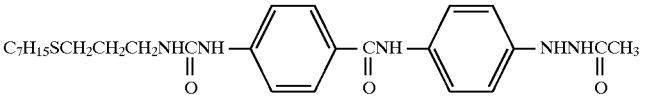
II-66
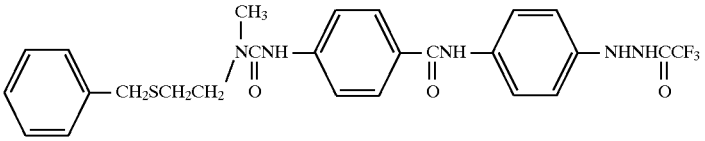
II-67
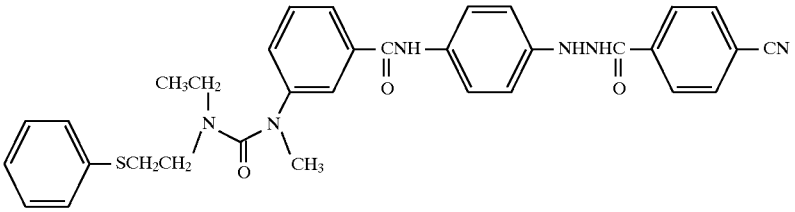

-continued
II-68
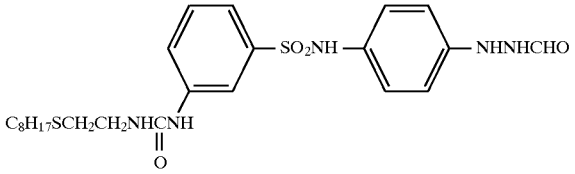
II-69
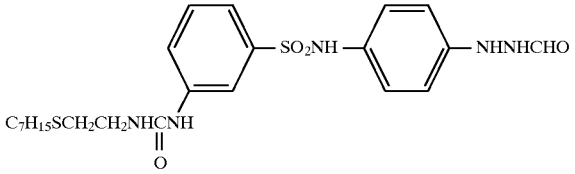
II-70
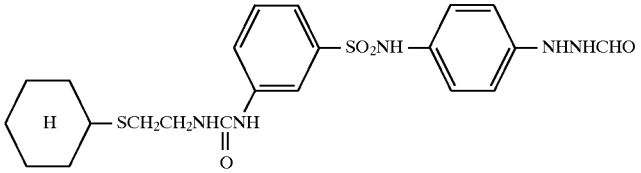
II-71
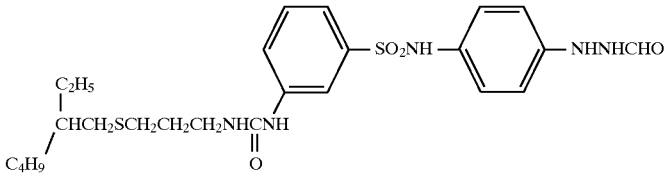
II-72
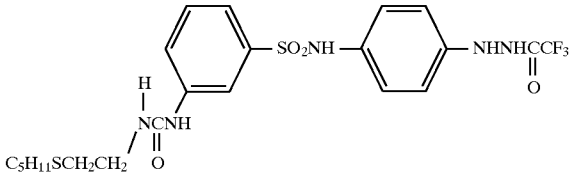
II-73
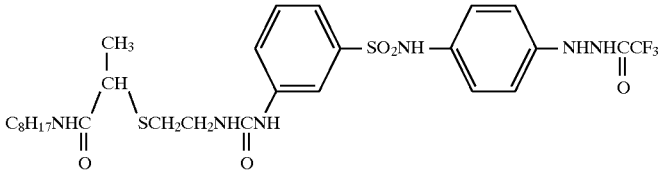
II-74
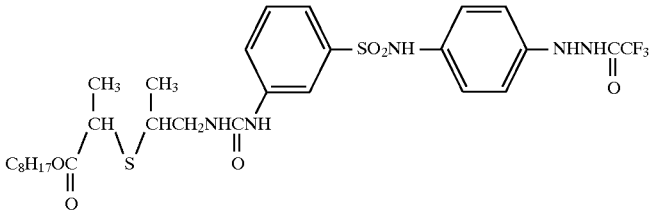
II-75
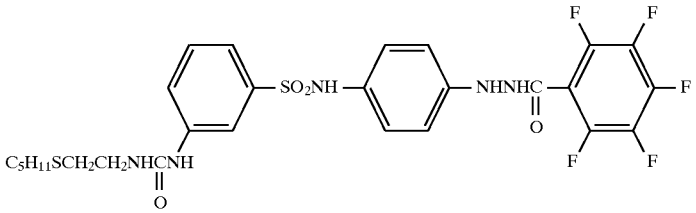

-continued
II-76
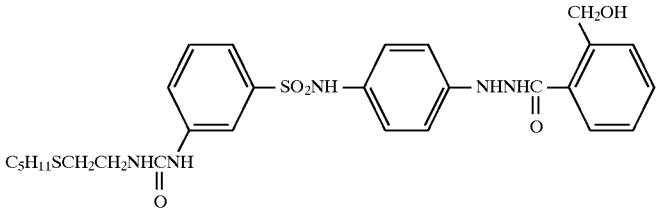
II-77
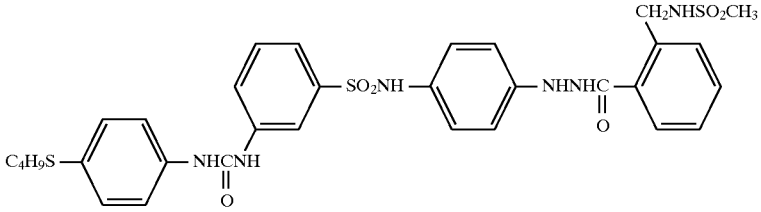
II-78
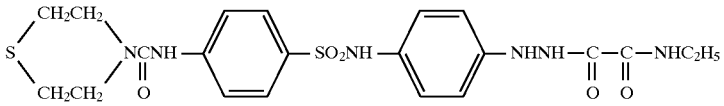
II-79
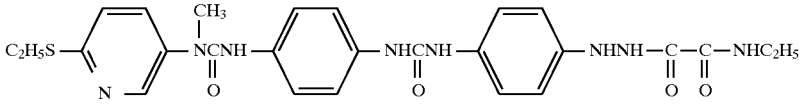
II-80
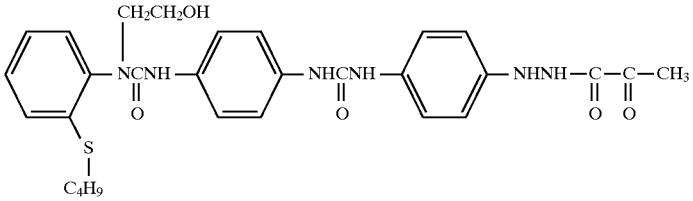
II-81
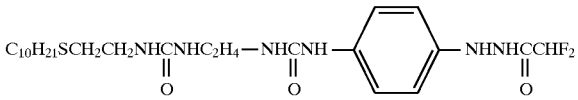
II-82
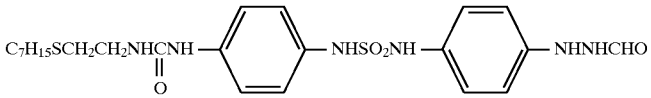
II-83
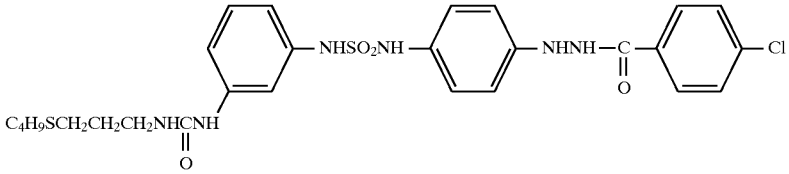
II-84
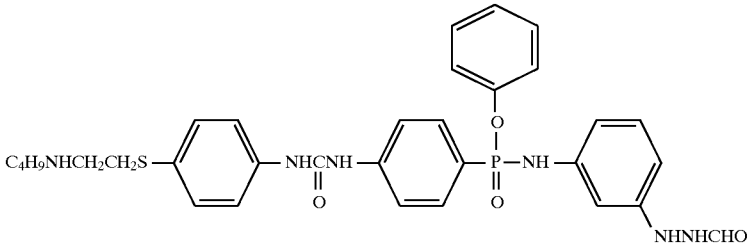

-continued
II-85
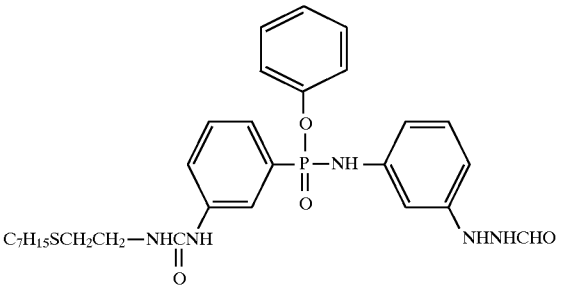
II-86
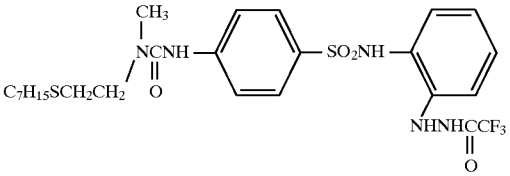
II-87
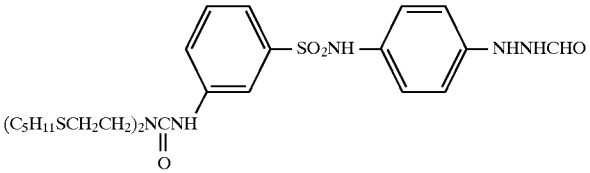
II-88
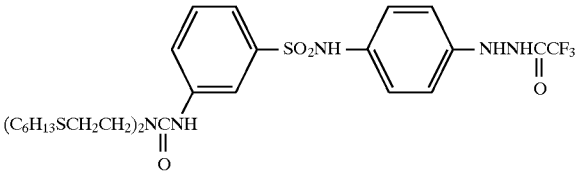
II-89
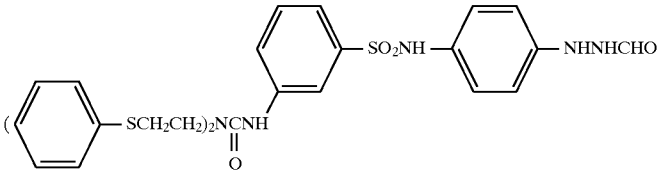
II-90
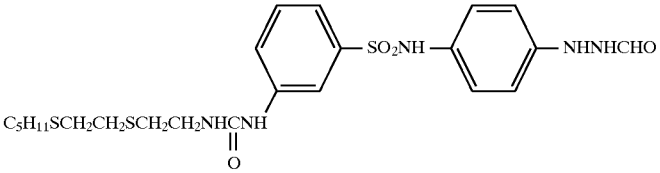
II-91
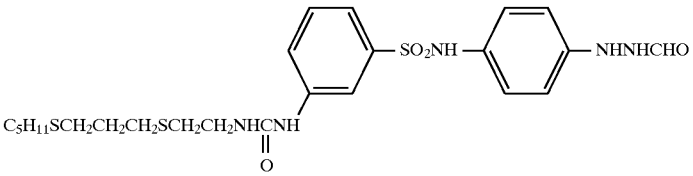
II-92
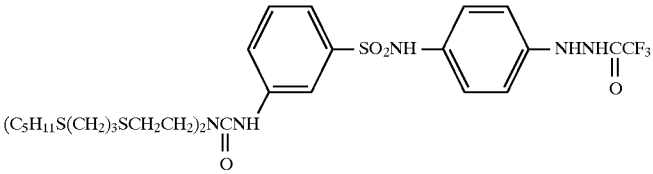

-continued
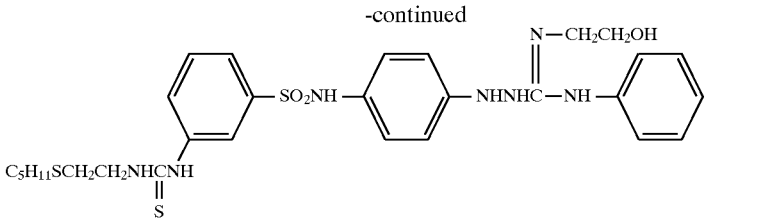
II-93
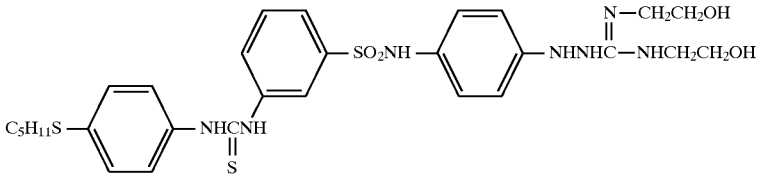
II-94
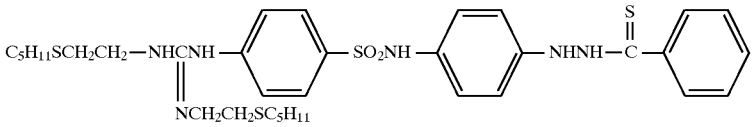
II-95
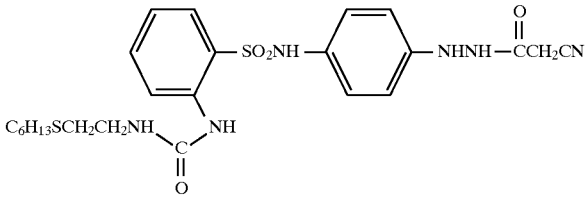
II-96
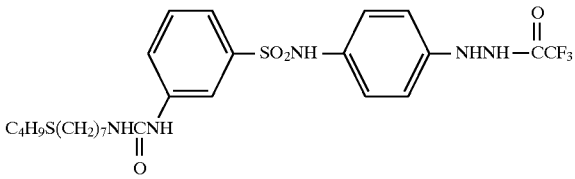
II-97
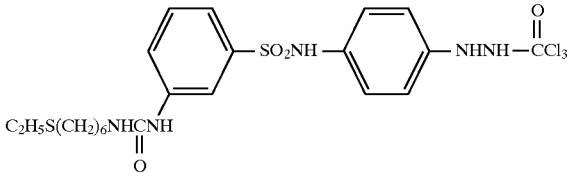
II-98
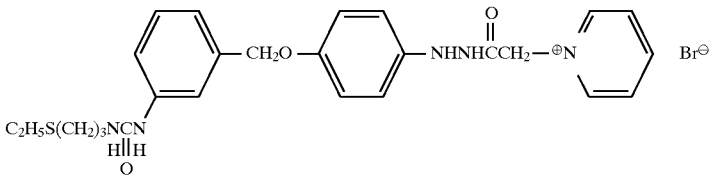
II-99
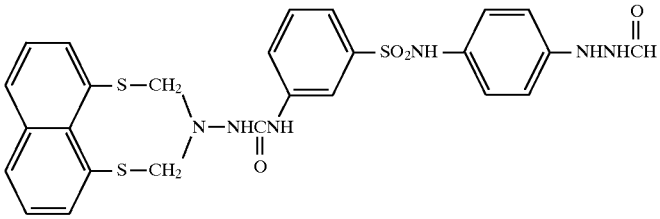
II-100
In addition to the above-illustrated ones, hydrazine derivatives which can be used in the present invention include those disclosed in *Research Disclosure*, Item 23516, page 346 (November, 1983), the references cited in supra, U.S. Pat. Nos. 4,080,207, 4,269,929, 4,276,364, 4,278,748, 4,385,108, 4,459,347, 4,560,638 and 4,478,928, British Patent 2,011,391B, JP-A-60-179734, JP-A-62-270948, JP-A-63-29751, JP-A-61-170733, JP-A-61-270744, European Patents 217,310 and 356,898, U.S. Pat. No. 4,686,167, JP-A-62-178246, JP-A-63-32538, JP-A-63-104047, JP-A-

63-121838, JP-A-63-129337, JP-A-63-223744, JP-A-63-234244, JP-A-63-234245, JP-A-63-234246, JP-A-63-294552, JP-A-63-306438, JP-A-64-10233, JP-A-1-90439, JP-A-1-100530, JP-A-1-105941, JP-A-1-105943, JP-A-1-276128, JP-A-1-280747, JP-A-1-283548, JP-A-1-283549, JP-A-1-285940, JP-A-2-2541, JP-A-2-77057, JP-A-2-139538, JP-A-2-196234, JP-A-2-196235, JP-A-2-198440, JP-A-2-198441, JP-A-2-198442, JP-A-2-220042, JP-A-2-221953, JP-A-2-221954, JP-A-2-302750 and JP-A-2-304550.

The hydrazine derivative of the present invention as described above is preferably added in an amount of from $1\times10^{-6}$ to $5\times10^{-2}$ mole, more preferably from $1\times10^{-5}$ to $2\times10^{-2}$ mole, per mole of silver halide.

In using the hydrazine derivative in the present invention, it may be dissolved in a proper water-miscible organic solvent, such as alcohols (e.g., methanol, ethanol, propanol, fluorinated alcohols), ketones (e.g., acetone, methyl ethyl ketone), dimethylformamide, dimethylsulfoxide and methyl cellosolve.

Also, the hydrazine derivative can be used in the form of emulsified dispersion, which is prepared using the well-known emulsion dispersion method in which the hydrazine derivative is dissolved using an oil such as dibutyl phthalate, tricresyl phosphate, glyceryl triacetate and diethyl phthalate, together with an auxiliary solvent, such as ethyl acetate and cyclohexanone, and then dispersed mechanically in an emulsified condition. On the other hand, the so-called solid dispersion method can be adopted in using the hydrazine derivative, wherein the powdered hydrazine derivative is dispersed into water by means of a ball mill, a colloid mill or ultrasonic waves.

The photographic materials of the present invention are not particularly restricted as to additives, and so various kinds of additives can be used therein. However, those disclosed in the following patent specifications can be preferably added thereto.

| Item | Reference and Passage therein |
|---|---|
| 1) Nucleation accelerators | The compounds represented by formulae (II-m) to (II-p), and Exemplified Compounds II-1 to II-22, disclosed in JP-A-2-103536, from page 9, right upper column, line 13, to page 16, left upper column, line 10; the compounds disclosed in JP-A-1-179939. |
| 2) Surfactants | JP-A-2-122363, at page 9, from right upper column, line 7, to right lower column, line 7; and JP-A-2-185424, from page 2, left lower column, line 13, to page 4, right lower column, line 18. |
| 3) Antifoggants | JP-A-2-103536, from page 17, right lower column, line 19, to page 18, right upper column, line 4, and page 18, right lower column, from line 1 to line 5; the thiosulfinic acid compounds disclosed in JP-A-1-237538. |
| 4) Polymer latexes | JP-A-2-103536, page 18, left lower column, from line 6 to line 20. |
| 5) Compounds containing an acidic group | JP-A-2-103536, from page 18, left lower column, line 6, to page 19, left upper column line 1. |

-continued

| Item | Reference and Passage therein |
|---|---|
| 6) Matting agent, Slipping agent, and Plasticizers | JP-A-2-103536, at page 19, from left upper column, line 15, to right upper column, line 15. |
| 7) Hardeners | JP-A-2-103536, at page 18, right upper column, from line 5 to line 17. |
| 8) Dyes | The dyes disclosed in JP-A-2-103536, at page 17, right lower column, from line 1 to line 18; the solid dyes disclosed in JP-A-2-294638 and JP-A-5-11382. |
| 9) Binders | JP-A-2-18542, at page 3, right lower column, from line 1 to line 20. |
| 10) Black spot inhibitors | The compounds disclosed in U.S. Pat. No. 4,956,257 and JP-A-1-118832. |
| 11) Redox compounds | The compounds represented by formula (I) disclosed in JP-A-2-301743 (especially Compounds 1 to 50); the compounds represented by formulae (R-1), (R-2) and (R-3), Exemplified Compounds 1 to 75, disclosed at pages 3 to 20 in JP-A-3-174143; the compounds disclosed in JP-A-5-257239 and JP-A-4-278939. |
| 12) Monomethine compounds | The compounds represented by formula (II) in JP-A-2-287532 (especially Exemplified Compounds II-1 to II-26). |
| 13) Dihydroxybenzenes | The compounds disclosed in JP-A-3-39948, from page 11, left upper column to page 12, left lower column, and those disclosed in EP-A-452772. |

Now, the present invention is illustrated below in more detail by reference to the following examples. However, the invention should not be construed as being limited to these examples.

EXAMPLE 1

<Preparation of Developers>

Developers containing the present compounds represented by formula (I) were prepared according to the prescription described below:

| | Developer | | |
|---|---|---|---|
| Ingredient | D-1 | D-2 | D-3 |
| Sodium hydroxide | 10.0 g | 10.0 g | 10.0 g |
| Diethylenetriamine tetraacetic acid | 1.5 g | 1.5 g | 1.5 g |
| Potassium carbonate | 15.0 g | 15.0 g | 15.0 g |
| Potassium bromide | 3.0 g | 3.0 g | 3.0 g |
| 5-Methylbenzotriazole | 0.10 g | 0.10 g | 0.10 g |
| 1-Phenyl-5-mercaptotetrazole | 0.02 g | 0.02 g | 0.02 g |
| Potassium sulfite | 10.0 g | 10.0 g | 10.0 g |
| Hydroquinone | — | — | 25.0 g |
| 4-Hydroxymethyl-4-methyl-1-phenyl-3-pyrazolidone | 0.4 g | — | 0.4 g |
| N-Methyl-p-aminophenol | — | 1.2 g | — |
| Compound (I-1) of present invention | 30.0 g | 30.0 g | — |
| Water to make | 1 l | 1 l | 1 l |
| pH | 10.7 | 10.7 | 10.7 |

Production of Silver Halide Photographic Material:

Emulsions were made in the following manner.

Emulsion A:

An aqueous silver nitrate solution and an aqueous potassium bromide solution containing $(NH_4)_2[RhCl_5(H_2O)]$ in the amount corresponding to $1.0\times10^{-7}$ mole per mole of silver and $K_3IrCl_6$ in the amount corresponding to $3.5\times10^{-7}$ mole per mole of silver were added to an agitated aqueous gelatin solution containing sodium chloride and 1,3-dimethyl-2-imidazolidinethione in accordance with a double jet method, and thereby was prepared a silver chlorobromide emulsion having an average grain size of 0.02 μm and a chloride content of 70% by mole.

Thereafter, a KI solution was added to the foregoing emulsion in an amount of $1\times10^{-3}$ mole per mole of silver to effect the conversion. The resulting emulsion underwent the washing step according to a conventional flocculation method, and then gelatin was added thereto in an amount of 40 g per mole of silver. Further, sodium benzenethiosulfonate and benzenesulfinic acid were added thereto in amounts of 7 mg and 2 mg, respectively, per mole of silver. Then, the thus obtained emulsion was divided into equal portions, and these portions were subjected to chemical sensitization under the following conditions respectively. To each of the chemically sensitized emulsion portions were added 150 mg of 4-hydroxy-6-methyl-1,3,3a,7-tetrazaindene as a stabilizer and 100 mg of Proxel as an antiseptic. The thus formed emulsion grains were cubic silver iodochlorobromide grains having an average size of 0.25 μm and a chloride content of 69.9% by mole.

Condition (a) for Chemical Sensitization:

The emulsion was adjusted to pH 6.0 and peg 7.8, and then chemically sensitized by adding thereto 3 mg/mole silver of 1,3,3-triethyl-2-thiourea and 4 mg/mole silver of chloroauric acid and ripening it at 65° C. so as to acquire the optimal sensitivity.

Condition (b) for Chemical Sensitization:

The emulsion was adjusted to pH 5.3 and peg 8.5, and then chemically sensitized by adding thereto 1 mg/mole silver of sodium thiosulfate, 1 mg/mole silver of Compound (K-1) illustrated below and 4 mg/mole silver of chloroauric acid and ripening it at 55° C. so as to acquire the optimal sensitivity.

Condition (c) for Chemical Sensitization:

Chemical sensitization was carried out under a condition such that the proportion of the chemical sensitization due to Compound (K-1) was increased but that due to sodium thiosulfate was reduced, compared with the foregoing condition (b).

More specifically, the emulsion was adjusted to pH 5.3 and peg 8.5, and then chemically sensitized by adding thereto 0.4 mg/mole silver of sodium thiosulfate, 2.3 mg/mole silver of Compound (K-1) illustrated below and 4 mg/mole silver of chloroauric acid and ripening it at 55° C. so as to acquire the optimal sensitivity.

Condition (d) for Chemical Sensitization:

The emulsion was adjusted to pH 5.3 and peg 8.5, and then chemically sensitized by adding thereto 1 mg/mole silver of sodium thiosulfate, 1 mg/mole silver of Compound (K-2) illustrated below and 4 mg/mole silver of chloroauric acid and ripening it at 55° C. so as to acquire the optimal sensitivity.

Condition (e) for Chemical Sensitization:

Chemical sensitization was carried out under a condition such that the proportion of the chemical sensitization due to Compound (K-2) was increased but that due to sodium thiosulfate was reduced, compared with the foregoing condition (d).

More specifically, the emulsion was adjusted to pH 5.3 and peg 8.5, and then chemically sensitized by adding thereto 0.25 mg/mole silver of sodium thiosulfate, 4 mg/mole silver of Compound (K-2) illustrated below and 4 mg/mole silver of chloroauric acid and ripening it at 55° C. so as to acquire the optimal sensitivity.

(K-1)

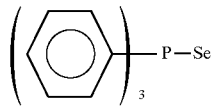

(Selenium Sensitizer No. 21)

(K-2)

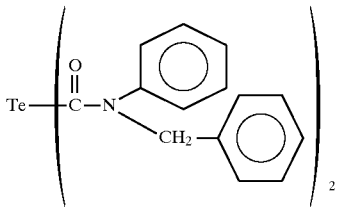

(Tellurium Sensitizer No. 70)

Emulsion B:

Ather emulsion was made in the same manner as Emulsion A, except that the cubic iodochlorobromide grains formed herein was controlled so as to have the chloride content of 30% by mole.

<Preparation of Emulsion-Coated Samples>

To each of the foregoing Emulsions A and B was added $5\times10^{-4}$ mole/mole Ag of Orthochromatically Sensitizing Dye (K-3) to effect orthochromatic sensitization. Thereto were further added hydroquinone and 1-phenyl-5-mercaptotetrazole as antifoggants in amounts of 2.5 g and 50 mg respectively per mole of Ag, 0.01 μm colloidal silica in the proportion of 30% to the gelatin binder, a polyethylacrylate latex as a plasticizer in the proportion of 25% to the gelatin binder, and 2-bis(vinylsulfonylacetamido)ethane as a hardener. The resulting emulsions were each coated on a polyester support so as to have an Ag coverage of 3.0 g/m$^2$ and a gelatin coverage of 1.0 g/m$^2$. At this time, a composition containing 0.10 g/m$^2$ of a matting agent (polymethylmethacrylate particles having an average size of 3.4 μm), 1.0 g/m$^2$ of gelatin and coating aids constituted of sodium p-dodecylbenzenesulfonate and Fluorine-containing Surfactant (K-4) illustrated below was coated as a light-insensitive upper layer simultaneously with the foregoing emulsion coating.

(K-3)

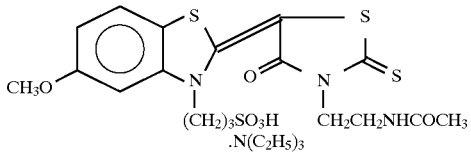

(K-4)

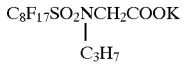

Additionally, the polyester support used above had the following backing and back protective layers.

Composition of Backing Layer:

| | |
|---|---|
| Gelatin | 2.0 g/m$^2$ |
| Sodium dodecylbenzenesulfonate | 80 mg/m$^2$ |
| Gelatin hardener (1,2-bis(vinylsulfonyl-acetamido)ethane) | 200 mg/m$^2$ |

-continued

| | |
|---|---|
| $SnO_2$/Sb (weight ratio: 90/10, average grain size: 0.20 μm) | 200 mg/m$^2$ |
| 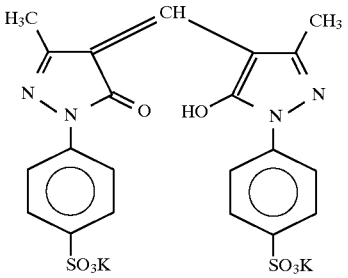 | 160 mg/m$^2$ |
| 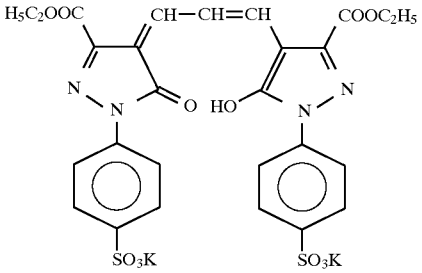 | 40 mg/m$^2$ |
| 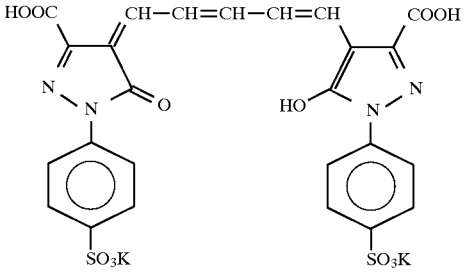 | 120 mg/m$^2$ |
| 1,3-divinylsulfone-2-propanol | 60 mg/m$^2$ |
| (Composition of Back Protective Layer) | |
| Gelatin | 0.5 g/m$^2$ |
| Polymethylmethacrylate (particle size: 4.7 μm) | 30 mg/m$^2$ |
| Sodium dodecylbenzenesulfonate | 20 mg/m$^2$ |
| Fluorine-containing surfactant (illustrated above as K-4) | 2 mg/m$^2$ |
| Silicone oil | 100 mg/m$^2$ |

Evaluation of Samples:

Each sample was exposed using a xenon flash light having an emission time of $10^{-5}$ second through an interference filter having a peak at 488 nm, and then subjected to sensitometry using an automatic developing machine, FG-710 NH, produced by Fuji Photo Film Co., Ltd. under the condition described below. Therein, the fixation was carried out using GR-F1, produced by Fuji Photo Film Co., Ltd., as a fixer, and the development was performed using any one of the aforementioned Developers, D-1, D-2 and D-3, as shown in Table 2.

| | | |
|---|---|---|
| Development | 38° C. | 14 seconds |
| Fixation | 37° C. | 9.7 seconds |
| Washing | 26° C. | 9 seconds |
| Squeeze | | 2.4 seconds |
| Drying | 55° C. | 8.3 seconds |
| Total time | | 43.4 seconds |

The reciprocal of the amount of exposure required for providing the density of 3.0 was adopted in determining the sensitivity. The sensitivities shown in Table 1 are relative values, with Sample No.1 being taken as 100. Further, the gradient was defined in terms of the slope of the straight line connecting the density points 0.1 and 3.0 on a characteristic curve was defined as the gradient, and shown in Table 1, too.

<Test of Physical Development Unevenness>

The unexposed samples were each processed at 38° C. for 20 seconds using an automatic developing machine, FG 360A, produced by Fuji Photo Film Co., Ltd., under the condition of suspending the function of the rinsing bath.

When unevenness generated in a sample through the foregoing processing (which is hereinafter termed the processing unevenness) was on an impractical level, a cross mark x was used to designate the evaluation result of the sample; when the processing unevenness was on a practical level, a triangle mark Δ was used; and when the processing unevenness was absent, a circle mark ○ was used.

TABLE 1

| Sample No. | Emulsion | Halide Composition | Chemical Sensitizing Condition | Developer | Sensitivity | Gradient | Fog | Processing Unevenness | Note |
|---|---|---|---|---|---|---|---|---|---|
| 1 | A | $AgBr_{20}Cl_{69.9}I_{0.1}$ | (a) | D-3 | 100 | 6.8 | 0.05 | x | comparison |
| 2 | " | " | (b) | D-3 | 125 | 7.0 | 0.06 | x | " |
| 3 | " | " | (c) | D-3 | 140 | 5.0 | 0.10 | x | " |
| 4 | " | " | (a) | D-1 | 93 | 7.0 | 0.05 | ○ | " |
| 5 | " | " | (b) | D-1 | 117 | 7.2 | 0.05 | ○ | invention |
| 6 | " | " | (c) | D-1 | 142 | 7.0 | 0.05 | ○ | " |
| 7 | " | " | (d) | D-1 | 119 | 7.1 | 0.05 | ○ | " |
| 8 | " | " | (e) | D-1 | 145 | 7.0 | 0.05 | ○ | " |
| 9 | " | " | (c) | D-2 | 140 | 7.2 | 0.05 | ○ | " |
| 10 | " | " | (e) | D-2 | 144 | 7.1 | 0.05 | ○ | " |
| 11 | B | $AgBr_{70}Cl_{29.9}I_{0.1}$ | (a) | D-3 | 105 | 6.0 | 0.05 | Δ | comparison |
| 12 | " | " | (b) | D-1 | 130 | 6.9 | 0.05 | ○ | invention |

According to the method of forming images using the present compound, as can be seen from Table 1, the sensitivity achieved was high, the image formed had high contrast and good quality, the fog density was low, and the unevenness due to physical development was hard to generate.

EXAMPLE 2

Dye (K-5) of the structural formula illustrated below was added in an amount of 50 mg per mole of Ag to each of Emulsions A and B obtained in Example 1. Thereto, disodium 4,4'-bis(4,6-dinaphthoxy-pyrimidine-2-ylamino) stilbene-disulfonate and 1-phenyl-5-mercaptotetrazole were further added in amounts of 234 mg and 25 mg, respectively, per mole of silver.

Thereto were furthermore added 150 mg/m$^2$ of hydroquinone, a polyethylacrylate latex in the proportion of 30% to the gelatin binder, 0.01 $\mu$m colloidal silica in the proportion of 30% to the gelatin binder, and 70 mg/m$^2$ of 0.5 g/m$^2$ of gelatin, 70 mg/m$^2$ of a dye having the following structural formula, a matting agent constituted of 60 mg/m$^2$ of polymethylmethacrylate particles having an average size of 2.5 $\mu$m and 70 mg/m$^2$ of colloidal silica having a grain size of 10 $\mu$m, coating aids constituted of sodium p-dodecylbenzenesulfonate and 1.5 mg/m$^2$ of a fluorine-containing surfactant having the structural formula illustrated below and 20 mg/m$^2$ of a chelating agent and being adjusted to pH 5.5 was coated as a protective layer simultaneously with the foregoing emulsion coating. In addition, the polyester support was provided with the same backing and back protective layers as in Example 1. The thus obtained samples were evaluated by the same method as in Example 1, except that an interference filter having a peak at 633 nm was used.

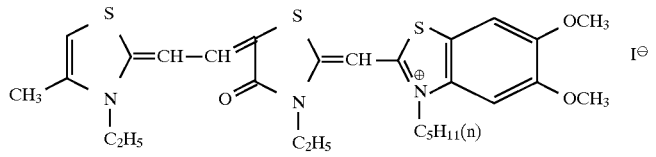

(K-5)

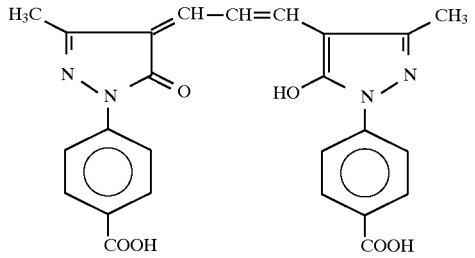

(Dye)

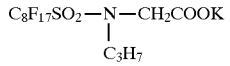

(Surfactant)

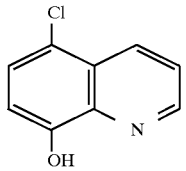

(Chelating agent)

TABLE 2

| Sample No. | Emulsion | Halide Composition | Chemical Sensitizing Condition | Developer | Sensitivity | Gradient | Fog | Processing Unevenness | Note |
|---|---|---|---|---|---|---|---|---|---|
| 1 | A | $AgBr_{20}Cl_{69.9}I_{0.1}$ | (a) | D-3 | 100 | 7.0 | 0.05 | x | comparison |
| 2 | " | " | (b) | D-3 | 123 | 7.1 | 0.07 | x | " |
| 3 | " | " | (c) | D-3 | 138 | 5.0 | 0.15 | x | " |
| 4 | " | " | (a) | D-1 | 90 | 7.2 | 0.05 | ○ | " |
| 5 | " | " | (b) | D-1 | 115 | 7.3 | 0.05 | ○ | invention |
| 6 | " | " | (c) | D-1 | 140 | 7.1 | 0.05 | ○ | " |
| 7 | " | " | (d) | D-1 | 120 | 7.1 | 0.05 | ○ | " |
| 8 | " | " | (e) | D-1 | 143 | 7.1 | 0.05 | ○ | " |
| 9 | B | $AgBr_{70}Cl_{29.9}I_{0.1}$ | (a) | D-3 | 110 | 6.2 | 0.05 | Δ | comparison |
| 10 | " | " | (b) | D-1 | 133 | 7.2 | 0.05 | ○ | invention |

2-bis(vinylsulfonylacetamido)ethane as a hardener. The resulting emulsions were each coated on a polyester support so as to have an Ag coverage of 3.2 g/m$^2$ and a gelatin coverage of 1.4 g/m$^2$. At this time, a composition containing According to the method of forming images using the present compound, as can be seen from Table 2, the sensitivity achieved was high, the image formed had high contrast and good quality, the fog density was low, and the unevenness due to physical development was hard to generate.

EXAMPLE 3

To Emulsion A obtained in Example 1 were added $5\times10^{-4}$ mole/mole Ag of Sensitizing Dye (K-6) illustrated below, $3\times10^{-4}$ mole/mole Ag of Mercapto Compound (K-7) illustrated below, $4\times10^{-4}$ mole/mole Ag of Triazine Compound (K-9) illustrated below, $2\times10^{-3}$ mole/mole Ag of 5-chloro-8-hydroxyquinoline, 0.5 mmole/mole Ag of Hydrazine Derivative II-34 and 1 mmole/mole Ag of Nucleation Accelerator (K-12). Thereto were further added 30 mg/m$^2$ of Water-soluble Latex (K-10) illustrated below, 200 mg/m$^2$ of a polyethylacrylate dispersion, 200 mg/m$^2$ of a latex copolymer prepared from methylacrylate, sodium 2-acrylamido-2-methylpropanesulfonate and 2-acetoacetoxyethylmethacrylate (having a ratio of 88:5:7 by weight) and 200 mg/m$^2$ of 1,3-divinylsulfonyl-2-propanol as a hardener. The resulting composition was adjusted to pH 6.0. The thus obtained composition was coated so as to have a silver coverage of 3.0 g/m$^2$ on a polyethylene terephthalate film having a moisture proofing undercoat on both sides.

On the emulsion layer thus formed was coated a protective layer containing 1.0 g/m$^2$ of gelatin, 40 mg/m$^2$ of amorphous $SiO_2$ measuring about 3.5 $\mu$m in average particle size as a matting agent, 0.1 g/m$^2$ of methanol silica, 100 mg/m$^2$ of polyacrylamide, 5 mg/m$^2$ of sodium ethylsulfonate, 200 mg/m$^2$ of hydroquinone, 20 mg/m$^2$ of silicone oil, and coating aids constituted of 5 mg/m$^2$ of Fluorine-containing Surfactant (K-11) illustrated below and 100 mg/m$^2$ of sodium dodecylbenzenesulfonate.

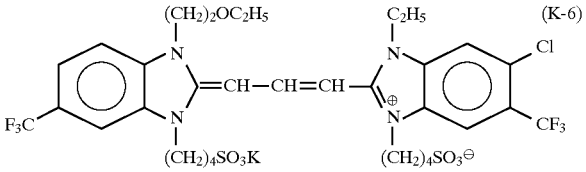
(K-6)

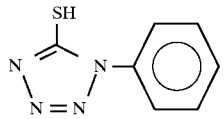
(K-7)

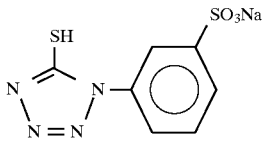
(K-8)

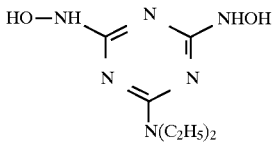
(K-9)

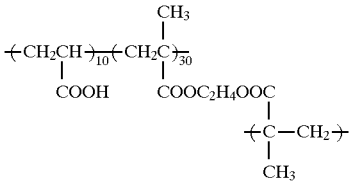
(K-10)

-continued

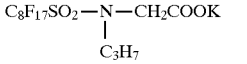
(K-11)

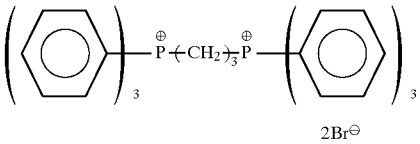
(K-12)

Exposure and Development:

Samples thus obtained were each exposed to tungsten light through a step wedge, and then developed at 35° C. for 30 seconds using as a developer the aforementioned Developer D-1 or D-3, followed by, in sequence, fixation, washing and drying operations. Herein, GR-F1 (products of Fuji Photo Film Co., Ltd.) was used as a fixer, and the photographic processing was performed with an automatic developing machine, FG-680A, products of Fuji Photo Film Co., Ltd.

The reciprocal of the amount of exposure required for providing the density of 1.5 was adopted in determining the sensitivity. The sensitivities shown in Table 3 are relative values, with Sample No.1 being taken as 100. The greater value therein means that the higher sensitivity the sample has. As for the indication of the image contrast (γ), there was adopted as the γ value a slope of the straight line connecting the density points fog+0.3 and fog+3.0 on a characteristic curve. Namely, γ=(3.0−0.3)/[log(the amount of exposure required for providing the density of 3.0)−log(the amount of exposure required for providing the density of 0.3)]. The greater γ value signifies that the sample has the more highly contrasty photographic characteristics.

The areas in which black spots appeared were observed under a microscope, and the samples processed in the above-described manner were evaluated by grading them by the extent of black spots in accordance with the following criterion: The grade 5 is given to a state such that the generation of black spots is not observed at all, so the sample is on the most excellent level; while the grade 1 is given to a state such that black spots generate to a considerable extent, so the sample is decidedly inferior in image quality. For practical it is required of the sample that the grade be at least 3.

TABLE 3

| Sample No. | Chemical Sensitizing Condition | Developer | Sensitivity | γ Value | Black Spots | Note |
|---|---|---|---|---|---|---|
| 1 | (a) | D - 3 | 100 | 20 | 4 | comparison |
| 2 | (b) | D - 3 | 111 | 15 | 1 | " |
| 3 | (d) | D - 3 | 109 | 13 | 1 | " |
| 4 | (a) | D - 1 | 98 | 21 | 5 | " |
| 5 | (b) | D - 1 | 110 | 22 | 5 | invention |
| 6 | (d) | D - 1 | 108 | 21 | 5 | " |

According to the image formation method using the present compound, as can be seen from Table 3, the sensitivity the contrast (γ) achieved were both high, and the ration of black spots was on a satisfactory level.

While the invention has been described in detail and reference to specific embodiments thereof, it will be rent to one skilled in the art that various changes and modifications can be made therein without departing from the it and scope thereof.

What is claimed is:

1. An image formation method, which comprises the steps of imagewise exposing a silver halide photographic material comprising a support having thereon at least one layer of a silver halide emulsion chemically sensitized with at least one selenium or tellurium compound, and then subjecting the material to development-processing with a developer containing substantially no dihydroxybenzene developing agent but containing a developing agent represented by the following formula (I):

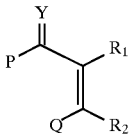

(I)

wherein $R_1$ represents —OH, —$NH_2$, —$NHSO_2CH_3$, —$NHCOCH_3$,

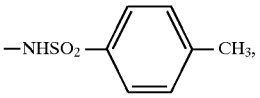

—NHCO—O—$C_2H_5$ or —SH;

$R_2$ represents —OH or —$NH_2$;

P and Q each represents an atomic group capable of forming a 5- to 7-membered ring by combining with each other, a hydroxyl group, or a hydroxyalkyl group; and Y represents =O or =NH;

provided that when P and Q form a 5-membered ring with Y being =O, $R_1$ and $R_2$ are both —OH or —$NH_2$, or $R_2$ is —OH, and $R_1$ is —$NHCOCH_3$, —$NHSO_2CH_3$,

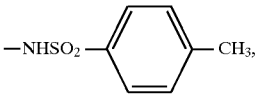

—SH or —$NHCOOC_2H_5$, when P and Q form a 5-membered ring with Y being =NH, $R_1$ and $R_2$ are both —OH, when P and Q form a 6-membered ring with Y being =O, $R_1$ and $R_2$ are both —OH, or $R_2$ is —OH and $R_1$ is —$NH_2$ or —$NHSO_2CH_3$, when P and Q form a 7-membered ring with Y being =O, $R_1$ is —$NH_2$ and $R_2$ is —OH, and when P is a hydroxyl group and Q is a hydroxyalkyl group, $R_1$ and $R_2$ are both —OH, or $R_1$ is —OH and $R_2$ is —$NH_2$;

wherein at least one layer of the emulsion layer and a hydrophilic colloid layer contains a hydrazine compound represented by the following formula (II):

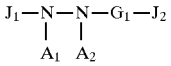

(II)

wherein $J_1$ represents an aliphatic group or an aromatic group; $J_2$ represents an alkyl group substituted with a substituent selected from the group consisting of a halogen atom, a cyano group, an alkylsulfonyl group, and an arylsulfonyl group, wherein the substituent is bonded to the carbon atom in the alkyl group which is directly bonded to $G_1$;

$G_1$ represents —CO—, —$SO_2$—, —SO—, —($J_3$)P(=O)—, —CO—CO—, a thiocarbonyl group or an iminomethylene group, wherein $J_3$ has the same meaning as $J_2$, but it may be different from $J_2$; and $A_1$ and $A_2$ are both a hydrogen atom, or one of $A_1$ and $A_2$ is a hydrogen atom and the other is a substituted or unsubstituted alkylsulfonyl group, a substituted or unsubstituted arylsulfonyl group or a substituted or unsubstituted acyl group;

wherein the developing agent of formula (I) is used in an amount of from $5\times10^{-3}$ to 1 mol per liter of developer, and the hydrazine compound of formula (II) is used in an amount of from $1\times10^{-6}$ to $5\times10^{-2}$ mol per mol of silver halide.

2. The image formation method as claimed in claim 1, wherein the silver halide emulsion has a silver chloride content of 50% by mole or more.

3. The image formation method as claimed in claim 1, wherein the silver halide photographic material is further sensitized with a sulfur sensitizer.

4. The image formation method as claimed in claim 1, wherein the silver halide photographic material is further sensitized with a gold sensitizer.

5. The image formation method as claimed in claim 1, wherein the silver halide photographic material is further sensitized with a sulfur sensitizer and a gold sensitizer.

6. The image formation method as claimed in claim 1 wherein the developing agent represented by formula (I) is at least one compound selected from the group consisting of:

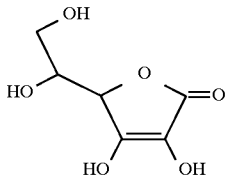

I-1

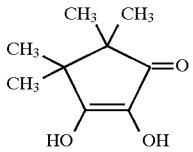

I-2

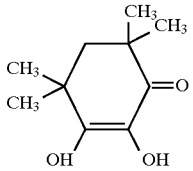

I-3

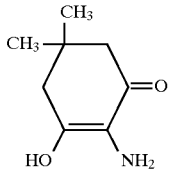

I-4

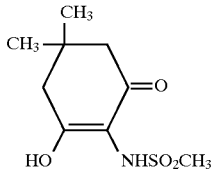

I-5

-continued
I-6
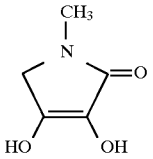
I-7
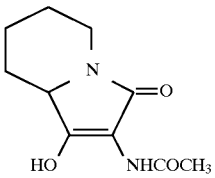
I-8
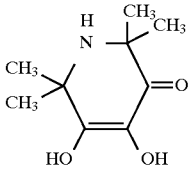
I-9
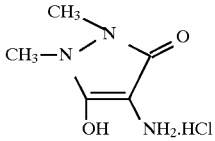
I-10
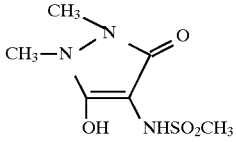
I-11
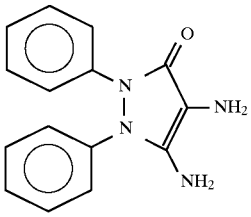
I-12
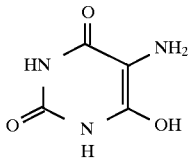
I-13
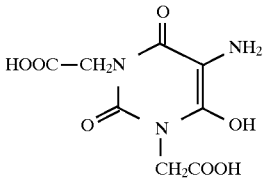
I-14
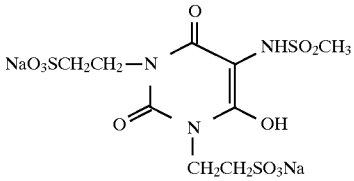
-continued
I-15
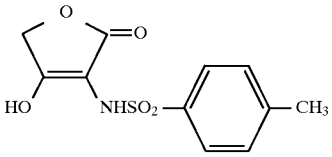
I-16
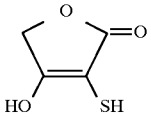
I-17
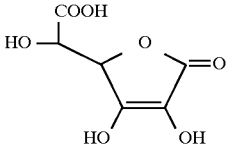
I-18
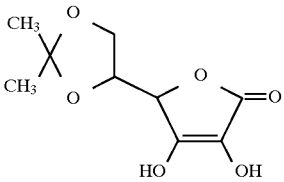
I-19
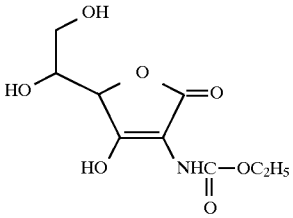
I-20
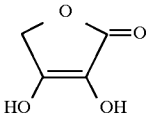
I-21
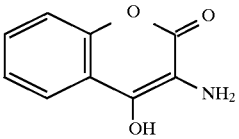
I-22
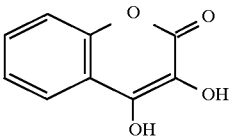
I-23
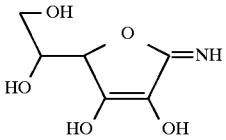
I-24
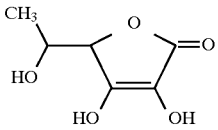

-continued

I-25

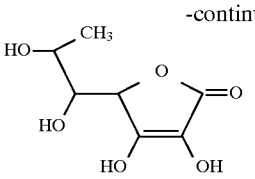

I-26

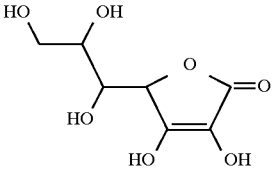

I-27

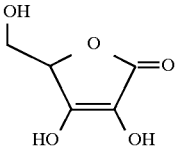

I-28

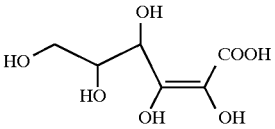

I-29

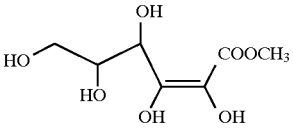

I-30

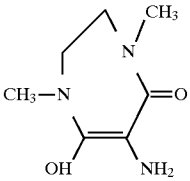

I-31

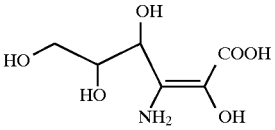

7. The image formation method as claimed in claim 1 wherein the developing agent represented by formula (I) is at least one of erythorbic acid and ascorbic acid.

8. An image formation method as claimed in claim 1, wherein $J_2$ is a methyl group substituted with a halogen atom, a cyano group, an alkylsulfonyl group, or an arylsulfonyl group.

9. An image formation method as claimed in claim 1, wherein the at least one selenium or tellurium compound is present in an amount of from $10^{-8}$ to $10^{-2}$ mole, the compound represented by formula (I) is present in an amount of from $5\times10^{-3}$ to 1 mole, and the hydrazine compound is present in an amount of from $1\times10^{-6}$ to $5\times10^{-2}$ mole.

10. The image formation method as claimed in claim 1, wherein $J_1$ is substituted by a substituent selected from the group consisting of an alkyl group, an aralkyl group, an alkenyl group, an alkinyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxyl group, a halogen atom, a cyano group, a sulfo group, an aryloxycarbonyl group, an acyl group, an alkoxycarbonyl group, an acyloxy group, a carbonamido group, a sulfonamido group, a carboxyl group, a phosphonamido group, a diacylamino group, an imido group, and $J_4$-NHCON($J_5$)—CO—, wherein $J_4$ and $J_5$ are chosen from the groups defined as $J_2$, and they may be the same or different.

11. The image formation method as claimed in claim 1, wherein $J_1$ is substituted by a substituent selected from the group consisting of an alkyl group, an aralkyl group, an alkoxy group, a substituted amino group, an acylamino group, a sulfonamido group, a ureido group and a phosphonamido group.

12. The image formation method as claimed in claim 1, wherein the silver halide emulsion contains silver halide grains that comprise at least one metal selected from the group consisting of rhodium and iridium in an amount of from $1\times10^{-9}$ to $1\times10^{-5}$ mol per mol of silver.

* * * * *